US006926385B2

(12) United States Patent
Rai et al.

(10) Patent No.: US 6,926,385 B2
(45) Date of Patent: Aug. 9, 2005

(54) RECORDING APPARATUS

(75) Inventors: Yoshihira Rai, Ebina (JP); Hiroaki Satoh, Ebina (JP); Nobuhiro Katsuta, Ebina (JP); Kenichi Kawauchi, Ebina (JP); Akira Mihara, Ebina (JP); Hiroshi Ikeda, Ebina (JP); Naoki Morita, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 58 days.

(21) Appl. No.: 10/661,212

(22) Filed: Sep. 15, 2003

(65) Prior Publication Data

US 2004/0179062 A1 Sep. 16, 2004

(30) Foreign Application Priority Data

Mar. 14, 2003 (JP) ..... 2003-069869

(51) Int. Cl.[7] ..... B41J 2/145; B41J 2/15
(52) U.S. Cl. ..... 347/40
(58) Field of Search ..... 347/40, 20, 42, 347/8

(56) References Cited

U.S. PATENT DOCUMENTS 5,510,815 A * 4/1996 Linder et al. ..... 347/8
6,502,922 B2 * 1/2003 Kawase et al. ..... 347/42
6,672,705 B2 * 1/2004 Kitahara et al. ..... 347/42

FOREIGN PATENT DOCUMENTS

| | | |
|---|---|---|
| JP | 2-225232 | 9/1990 |
| JP | 10-157229 | 6/1998 |

* cited by examiner

*Primary Examiner*—Thinh Nguyen
(74) *Attorney, Agent, or Firm*—Morgan Lewis & Bockius LLP

(57) ABSTRACT

A recording apparatus enabling printing with high image quality is to be provided. In a recording apparatus exerting recordation having a non-scanning recording head corresponding to the total width of the paper, a pressing member and a supporting member are disposed among plural recording head units, which are arranged in the width direction of the paper with a prescribed interval, and thus the paper continuously conveyed is pressed with the pressing member onto the supporting member, so as to uniformize the distance between the paper and the nozzle surface at the printing position. As a result, printing can be attained with high image quality on the paper continuously conveyed.

20 Claims, 28 Drawing Sheets

RECORDING APPARATUS

BACKGROUND OF THE INVENTION

1. Field of the Invention

The present invention relate to a recording device used as an output device of an ink-jet recording apparatus exerting recordation by discharging an ink from a recording unit to a recording medium, and an apparatus having such a function, e.g., a facsimile, a duplicator, a printer multifunction machine and a workstation.

2. Description of the Related Art

In recent years, color documents have been widely spread in office use, and various kinds of output apparatuses have been proposed therefor. In particular, an ink-jet system, which can be miniaturized with low cost, is used in various kinds of output apparatuses.

A recording head used in the ink-jet system is constituted with an energy generating unit, an energy converting unit for converting energy generated by the energy generating unit to an ink discharging force, an ink discharging outlet for discharging an ink droplet with the ink discharging force, and an ink feeding path connected to the ink discharging outlet for feeding an ink. Examples of the energy generating unit include devices using an electromechanical converting element, such as a piezoelectric element, and devices, in which an ink is heated with an electrothermal conversion element having a resistive heater element to form a bubble, and the ink is discharged with the formation of the bubble.

In the recording head utilizing an electrothermal conversion element, not only ink discharging outlets can be arranged at a high density owing to the small size of the electrothermal conversion element, but also a production technique of a semiconductor integrated circuit can be transferred for the production technique therefor. Accordingly, a recording head having a large number of ink discharging outlets can be miniaturized and can be produced at low cost.

However, what has been commonly used is a printing system referred to as a serial scanning system, in which a recording head is reciprocally moved with recording paper being conveyed to print by one line. While the system is of a small size and low cost, it has such a problem in that the printing speed is low due to necessity of plural frequencies of scanning of the recording head for forming an image over the paper. It is necessary to lower the scanning frequency in order to improve the printing speed, and extension of a recording head is essential therefor. At the outrance of the extension of a recording head, such a non-scanning printing system is proposed in that a recording head having the same width as recording paper is used. The printing system uses an ink-jet recording apparatus having a recording head having a width equivalent to recording paper, within which a large number of discharging outlets are arranged over the length, which is substantially the same as the recording paper, and recordation is effected by moving the recording paper with respect to the fixed recording head.

In order to improve the productivity, such a recording apparatus capable of printing over the paper width have been thus proposed that has a long recording head having a width equivalent to the maximum paper width of the recording paper and carries out printing with the paper being conveyed. It has been known that the recording head capable of printing over the paper width is not only constituted with a monolithic long recording head having a length equivalent to the paper width but also constituted by arranging short heads in a staggered manner or by arranging them with the ends thereof being in contact with each other.

In the ink-jet recording apparatus, an ink droplet discharged from a nozzle of the recording head flies and impacts on the paper to form an image. At this time, because the discharging velocity of the ink droplet is generally constant, fluctuation in the flying distance (i.e., the distance between the recording head (nozzle surface) and the paper) causes fluctuation in the impact position of the ink droplet, which directly influences the quality of the image thus formed.

In the conventional recording apparatus having a scanning type recording head, accordingly, the distance between the recording head and the paper is generally uniformized in such a manner that the paper is intermittently conveyed and is exactly fixed on a platen at the printing position.

In the case of printing over the paper width, on the other hand, the paper is continuously conveyed by using a belt, a drum or the like, and therefore, an electrostatic adsorption system, a negative pressure adsorption system or the like is used as a uniformizing system for maintaining uniform the distance between the nozzle surface and the paper.

For example, as a system for uniformizing at the printing position, such methods have been proposed as a method of electrostatically adsorbing paper on a platen (as described, for example, in JP-A-2-225232), a method of aspirating paper by negative pressure (as described, for example, in JP-A-10-157229), and the like.

However, it has been well known in the art that paper is swelled and deformed at a part, at which an ink is attached, to cause ununiform deformation over the entire paper, and the surface potential and the conveying resistance (friction coefficient) thereof are also changed. The extents of the deformation and the changes greatly depend on the quality and the thickness of the paper.

In the conventional technique using the electrostatic adsorption and the negative pressure aspiration, it has been confirmed that deformation of the paper caused by penetration of an ink due to change in surface potential cannot be avoided, and a part of the paper is left from the conveying members (such as a belt and a drum) during printing. Accordingly, it is difficult to maintain uniform the distance between the nozzle surface of the recording head arranged over the paper width and the paper.

In the case where the paper is conveyed with a belt, furthermore, there is such a possibility that the distance between the nozzle head of the recording head and the paper is changed by vertical movement of the belt, such as vibration. Moreover, there is also such a possibility that the tip end part of the paper is deformed in the vertical direction upon conveying due to against wind (i.e., air resistance) to change the distance to the nozzle surface of the recording head.

As a result, the distance between the recording head (nozzle surface) and the paper is changed to differentiate the flight time of the ink droplets, whereby the image quality is deteriorated.

SUMMARY OF THE INVENTION

The present invention has been made in view of the above circumstance and provides a recording apparatus capable of stably attaining high quality printing in printing over the paper width.

The recording apparatus of the invention exerts recordation on a recording medium by discharging a ink droplet from a recording head to a recording medium continuously conveyed, and contains a non-scanning recording head containing plural recording head units, each of which discharges an ink droplet to a recording medium, arranged in a width direction intersecting a conveying direction of the recording medium, and a uniformizing unit for keeping a distance between the recording medium and a ink droplet discharging surface of the recording head unit, arranged among the recording head units in the width direction.

The function of the recording apparatus of the invention will be described.

In a recording apparatus having a non-scanning recording head, printing is effected by discharging a ink droplet from recording head units constituting the recording head while the recording medium is continuously conveyed. At this time, owing to the provision of the uniformizing unit arranged among the recording head units in the width direction, the recording medium reaching the recording position attains a uniform distance to the ink droplet discharging surface of the recording head unit with the uniformizing unit, so as to enable printing with high image quality.

BRIEF DESCRIPTION OF THE DRAWINGS

Preferred embodiments of the present invention will be described in detail based on the following figures, wherein.

DESCRIPTION OF THE PREFERRED EMBODIMENTS

An ink-jet recording apparatus according to an embodiment of the invention will be described.

Figure 1:
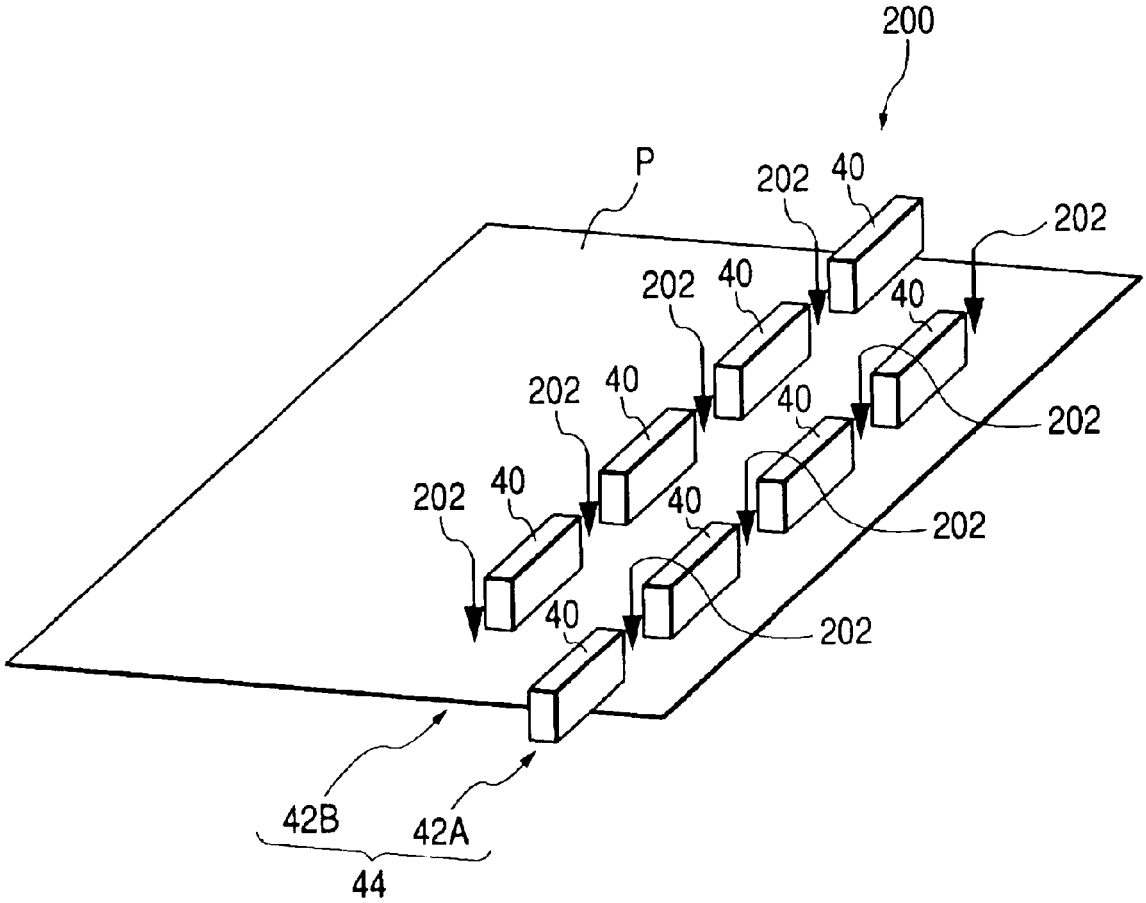
FIG. 1 is a schematic constitutional view showing a recording apparatus according to an embodiment of the invention.
Figure 2:
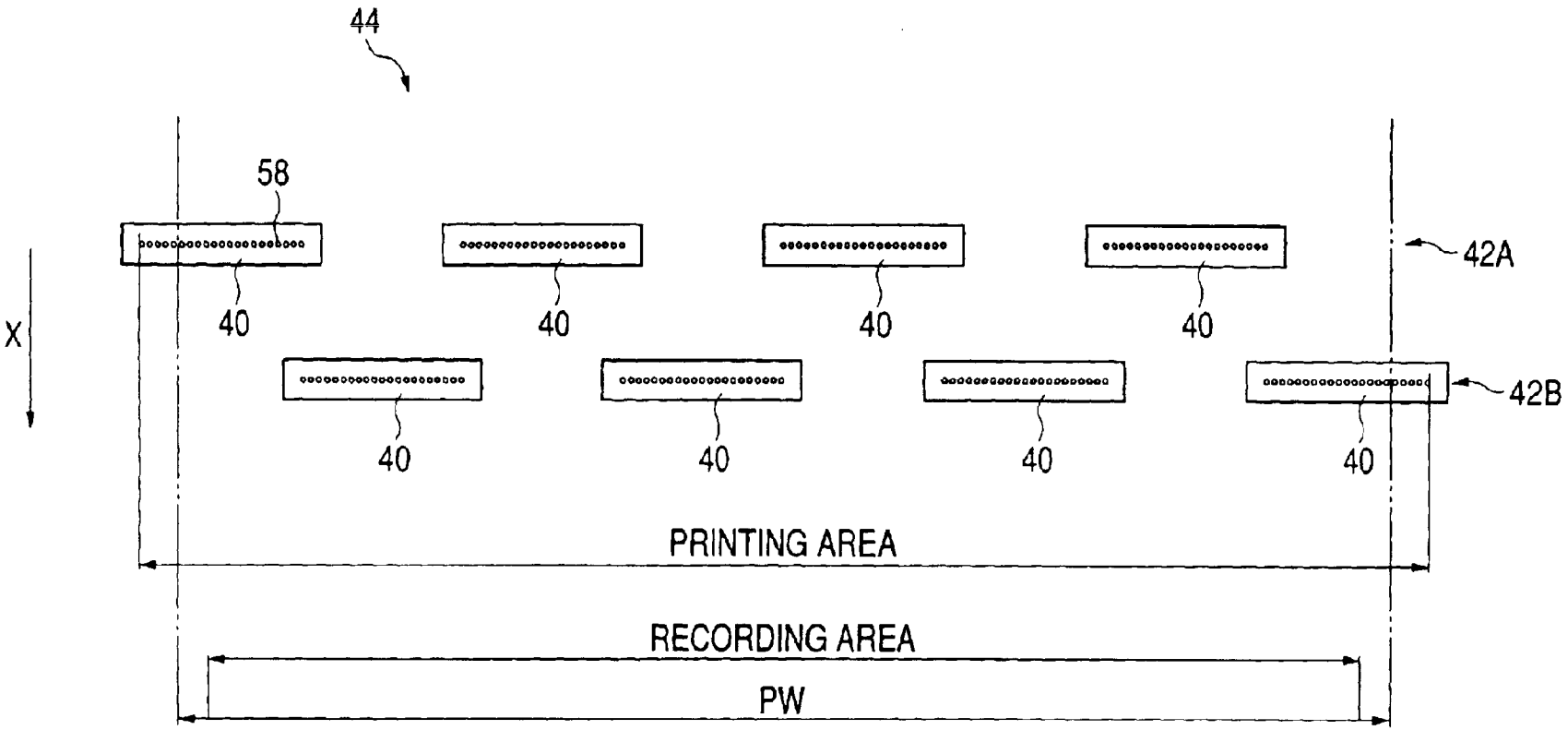
FIG. 2 is a schematic plane view showing a recording head according to an embodiment of the invention.

As shown in FIG. 1, a recording apparatus 200 is basically constituted with a recording head 44 constituted with plural recording head units 40, which directly transfer an ink in a noncontact manner to paper P continuously conveyed (as shown in FIG. 2), and a uniformizing unit 202 for keeping a distance between a nozzle surface 40A of the recording head unit 40 and the paper.

Figure 3:
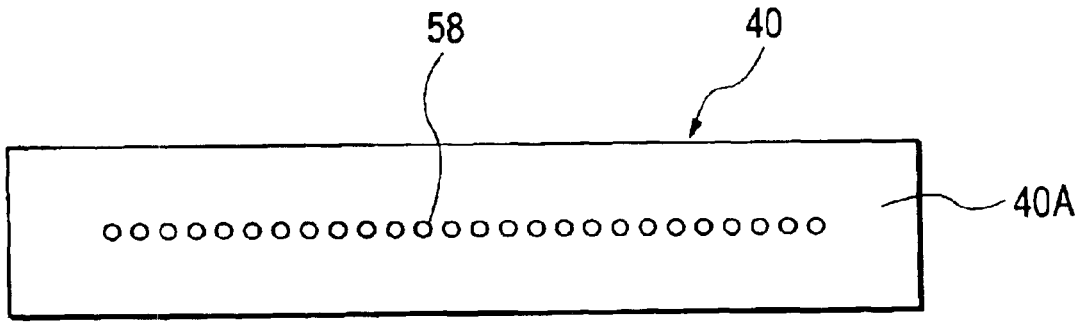
FIG. 3 is a plane view showing a recording head unit according to an embodiment of the invention.

As shown in FIG. 3, the recording head unit 40 has nozzles 58 arranged on the nozzle surface 40A in one row, and an ink is transferred in a noncontact manner from the nozzle 58 to the paper. The ink-jet system may be any of a thermal ink-jet system, a piezoelectric ink-jet system, a continuous flow ink-jet system and an electrostatic suction ink-jet system.

The ink used herein may be an aqueous ink, an oily ink, a so-called solid ink, which is in a solid state at ordinary temperatures, and a solvent ink. A colorant contained in the ink may be either a pigment or a dye.

In the recording head 44, as shown in FIG. 2, plural recording head units 40 are arranged in such a manner that the nozzle rows thereof agree with the width direction intersecting the conveying direction (the direction shown by the arrow X) of the paper P to constitute recording head arrays 42A and 42B, and the recording head arrays 42A and 42B are arranged in such a manner that the recording head units 40 constituting the recording head arrays 42A and 42B are arranged to overlap each other by deviating from each other in the width direction, so as to enable printing without gap over the printing area.

That is, as shown in FIG. 2, the recording head 44 has the printing area corresponding to the maximum paper width PW of the paper P, and can print over the total width of the paper without scanning the recording head 44.

In the case where a printing margin is set in the paper, the printing area of the recording head 44 may be such a width that corresponds to the recording area (more than the recording area) obtained by subtracting the printing margin from the maximum paper width PW.

In general, the paper may be conveyed in a direction that is skewed at a certain angle from the conveying direction, and there is a demand of rimless printing. Therefore, it is preferred that the printing area of the recording head 44 is larger than the recording area.

Figure 4:
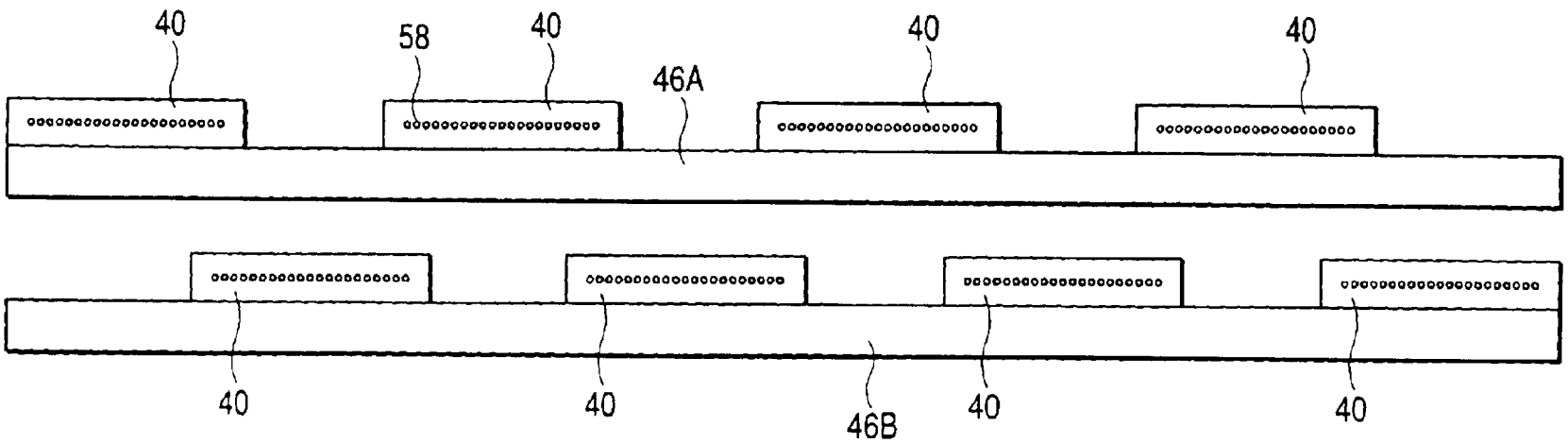
FIG. 4 is a schematic plane view showing an example of a recording head according to an embodiment of the invention.

It is preferred that the recording head units 40 thus arranged are at least attached to common substrates 46A and 46B constituting the recording head arrays 42A and 42B, respectively (as shown in FIG. 4). This is because, owing to the arrangement of the recording head units 40 on the common substrates 46A and 46B, (1) the recording head units 40 can be positioned with high accuracy, (2) an electronic circuit board can be attached to the common substrates 46A and 46B, whereby an electric power source and a signal for driving the recording head units 40 can be constituted, and a flow path for feeding an ink can be provided on or formed in the substrates, and (3) the substrates can be used as a heat sink of the recording head units 40 in the case using the thermal ink-jet system.

Figure 5:
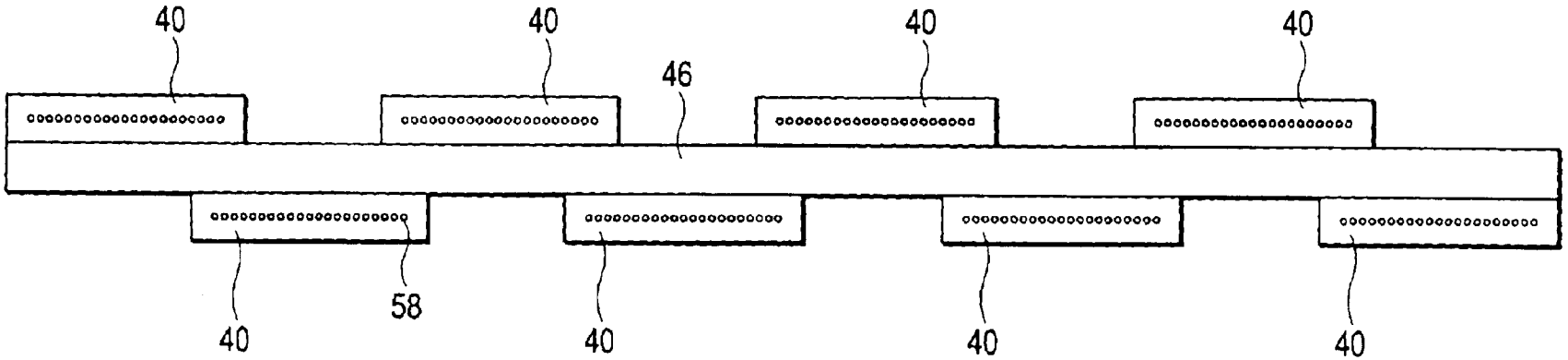
FIG. 5 is a schematic plane view showing another example of a recording head according to an embodiment of the invention.

In alternative, as shown in FIG. 5, the recording head arrays 42A and 42B may be constituted by arranging the recording head units 40 on both sides of one common substrate 46. According to the configuration, the recording head 44 can be miniaturized with the common substrate 46 that is commonly used therefor.

The recording head unit may be driven from a commercially available or known ink-jet recording head for serial recordation. It is also possible that the recording head unit is constituted only with a head chip, and an ink is fed to the plural head chips through in feeding paths provided on the common substrate 46. It is furthermore preferred that the every recording head units can be replaced one by one.

Figure 6:
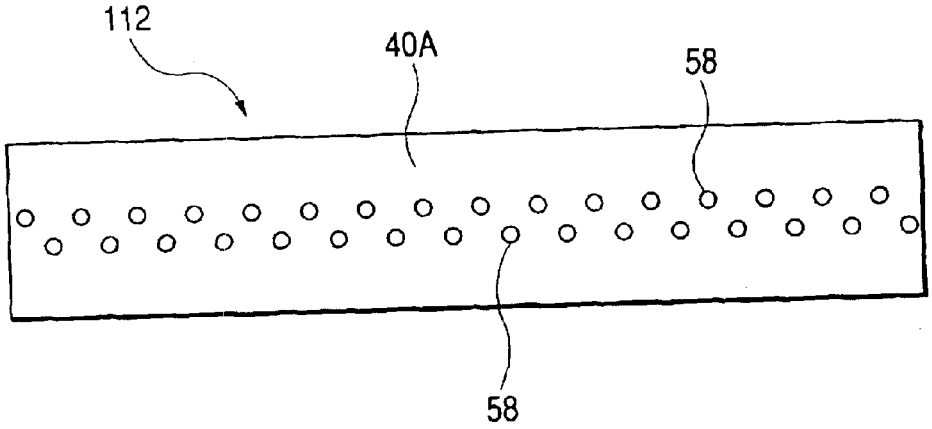
FIG. 6 is a schematic plane view showing another example of a recording head according to an embodiment of the invention.

While the straight nozzle arrangement of the recording head units 40 has been described herein, it is not limited thereto. For example, as shown in FIG. 6, such a recording head unit 112 may be used in that nozzles 58 are arranged in a staggered manner.

The uniformizing units 202 are arranged adjacent to the every recording head units 40 in the width direction as shown in FIG. 1, and are to apply a force to the paper in the perpendicular direction, whereby the distance between the nozzle surfaces 40A of the recording head units 40 and the paper is uniformized.

Figure 7:
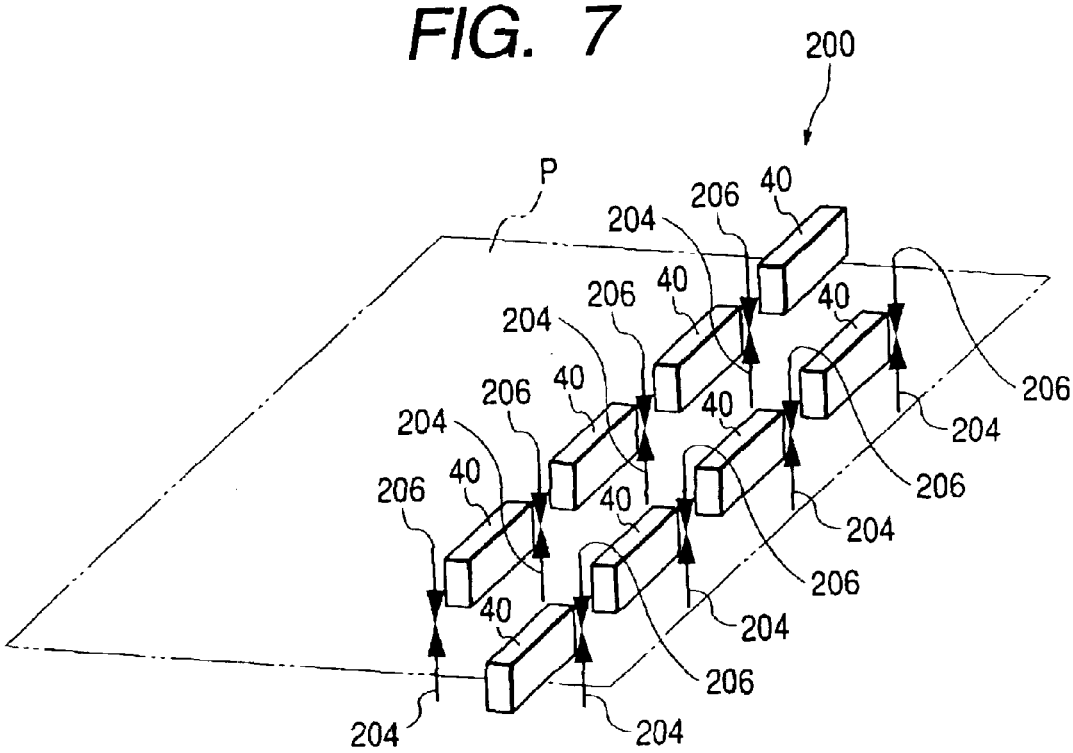
FIG. 7 is a schematic view showing a constitution of a pressing member according to an embodiment of the invention.

The uniformizing unit 202 may be constituted, for example, with a supporting member 204 for supporting the back surface of the paper, and a pressing member 206 for pressing the recording surface of the paper onto the supporting member 204, as shown in FIG. 7. In the case where the pressing member 206 presses the paper onto the supporting member 204 with the own weight thereof, such an advantage is obtained that the pressing force can be constant irrespective to the species of the paper, and in the case where it presses with an elastic force, such an advantage is obtained that the pressing force can be adjusted.

The uniformizing unit 202 is not limited to the combination of the supporting member 204 and the pressing member 206, and may be constituted with a suction force or a repulsive force of a magnet, or with spraying of a gas. In the case where a magnetic force is utilized, such an advantage is obtained that influence of contamination with an ink, such as attachment of ink mist, can be avoided. In the case where a gas is sprayed, such an advantage is obtained that the effect is obtained with a noncontact manner.

Figure 8:
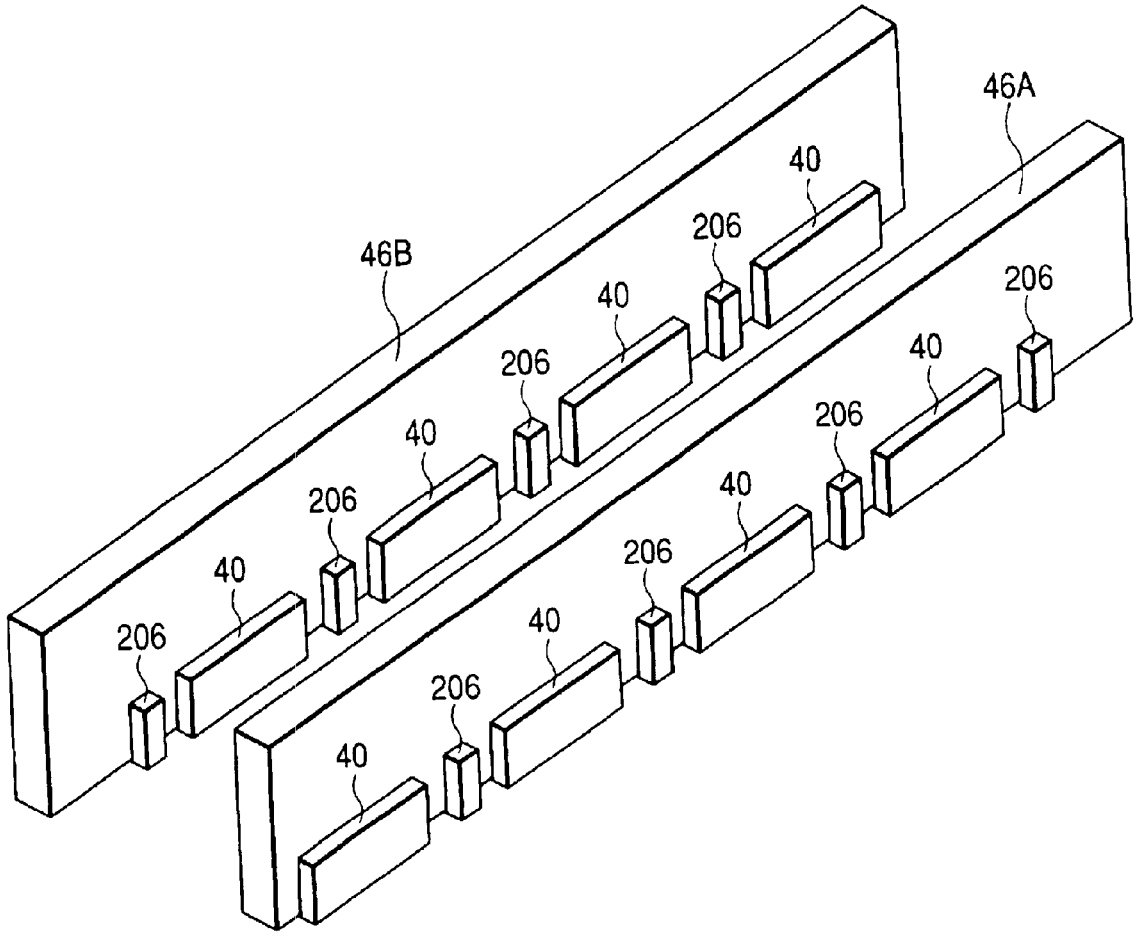
FIG. 8 is a schematic view showing installation of a pressing member according to an embodiment of the invention.

In the case where the pressing member 206 is used in the uniformizing unit, it is preferred that the pressing member 206 is attached to the common substrate 46, as shown in FIG. 8.

The pressing position in the paper conveying direction where the pressing member 206 presses the paper identically agree with the nozzle position (i.e., the printing position) of the recording head unit 40, and it is generally in a range of ±10 mm from the printing position, preferably in a range of ±2 mm therefrom, and more preferably in a range of ±0.5 mm therefrom.

The interval of the pressing members 206 in the width direction is about 80 mm at the maximum. This is because the uniformity of the distance between the nozzle surface and the paper in the width direction is difficult to be maintained in the case where the pressing interval is larger than that value.

Figure 9:
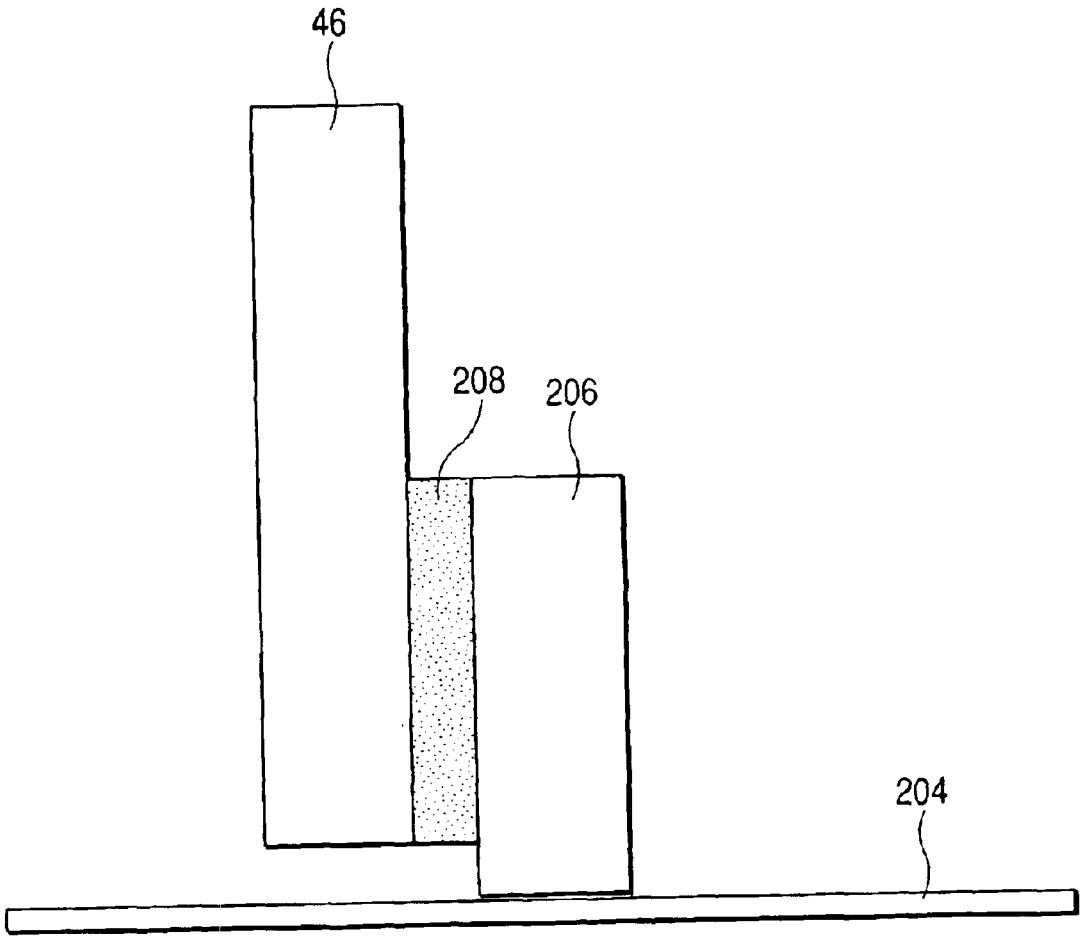
FIG. 9 is a side view showing an pushing unit for a pressing member according to an embodiment of the invention.

In the case where the paper is pressed with the pressing member 206, furthermore, it is preferred that an pushing unit for pushing the pressing member 206 toward the side of the supporting member 204 has elasticity. For example, such a constitution as shown in FIG. 9 can be exemplified in that the pressing member 206 is supported on the common substrate 46 through an elastic member 208.

Figure 10:
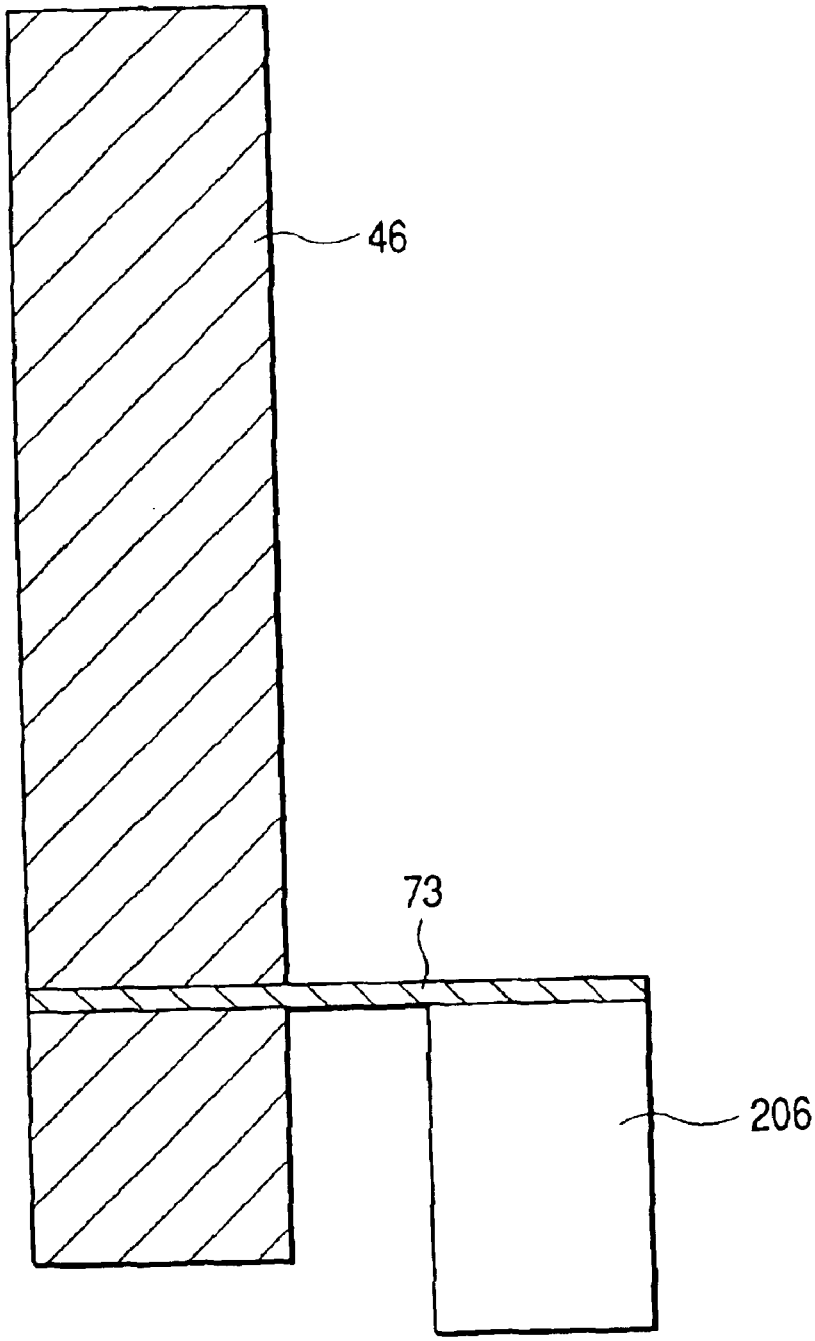
FIG. 10 is a side view showing another example of an pushing unit for a pressing member according to an embodiment of the invention.

The elastic member 208 may be any of metals, resins, rubber and the like as far as it has such a shape and a material that exert an elastic function. A stainless steel material is preferred as the metal, polypropylene is preferred as the resin, and silicone rubber is preferred as the rubber, from the standpoint of resistance to an ink. It is preferred that the elastic member 208 can be deformed only in the discharging direction of the ink droplet. For example, such a constitution as shown in FIG. 10 can be exemplified in that the pressing member 206 is retained on the common substrate 46 through a blade spring 73.

Figure 11:
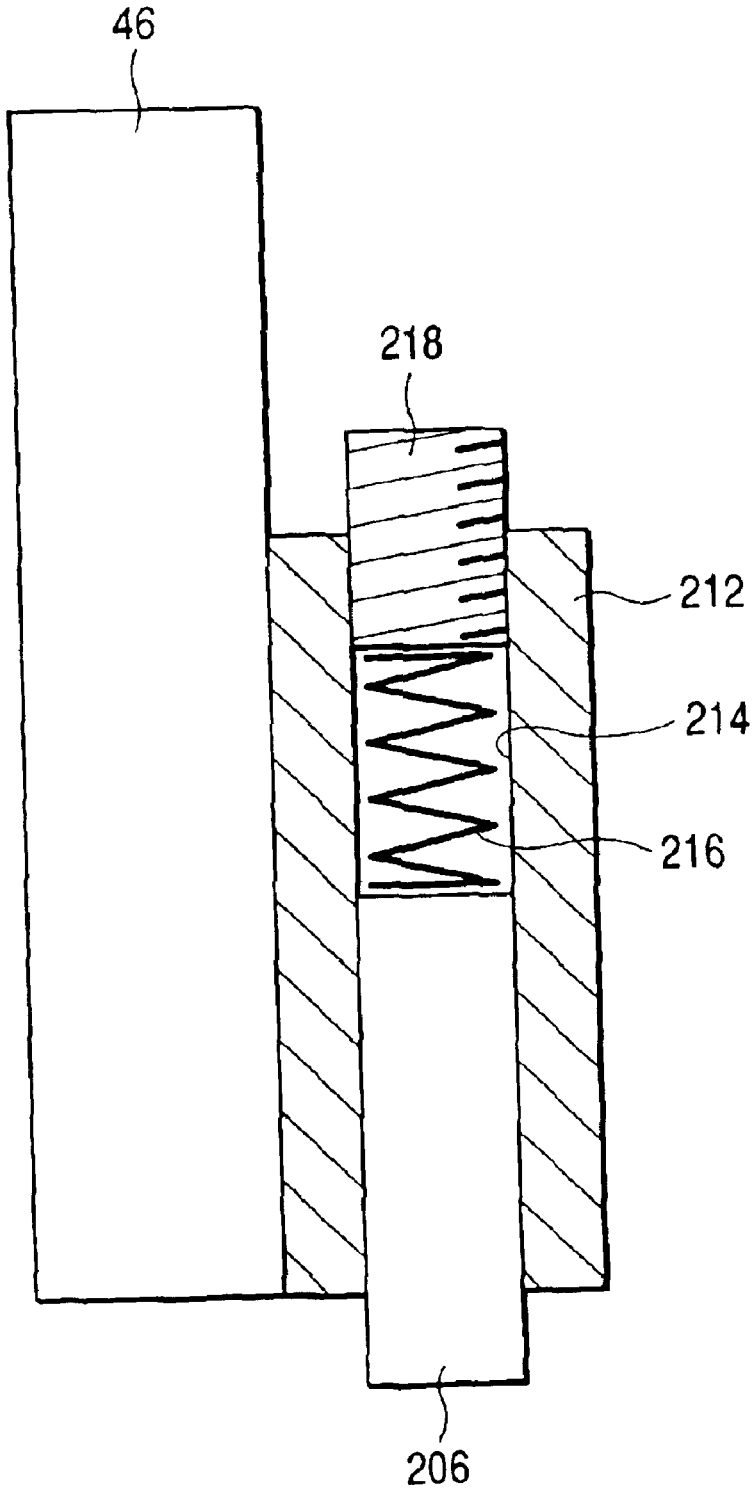
FIG. 11 is a side view showing a pressing pressure adjusting unit according to an embodiment of the invention.

It is also preferred to use a unit for adjusting the pressing force. For example, in such a constitution as shown in FIG. 11 in that a pressing force is applied to the pressing member 206 with a compression spring 216 disposed in an opening 214 of a supporting part 212 provided on the common substrate 46, the compression spring 216 may be expanded or compressed by rotating a push screw 218 to adjust the elastic force (i.e., the pressing force) applied to the pressing member 206.

Figure 12:
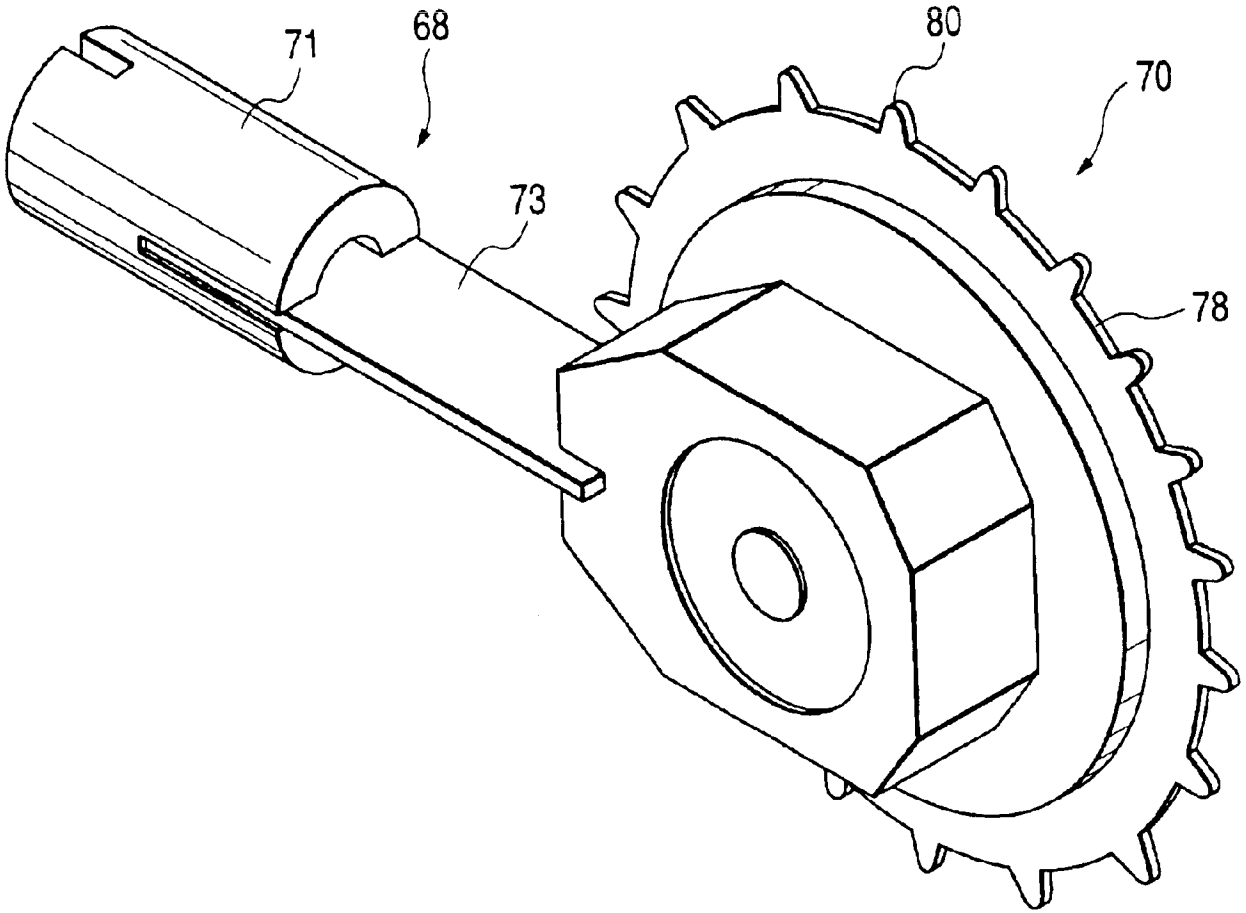
FIG. 12 is a perspective view showing a star wheel and a retaining member according to an embodiment of the invention.

The pressing member is preferably a spur (star wheel) 70 capable of being rotationally driven as shown in FIG. 12, which provides a minimum contact area to the paper, because it is in direct contact with the recording surface of the paper.

The star wheel 70 may be, for example, elastically supported through a blade spring 73 at a tip end of a supporting member 71 engaged with an opening 66 of the common substrate 46, as shown in FIG. 14.

Figure 13A:
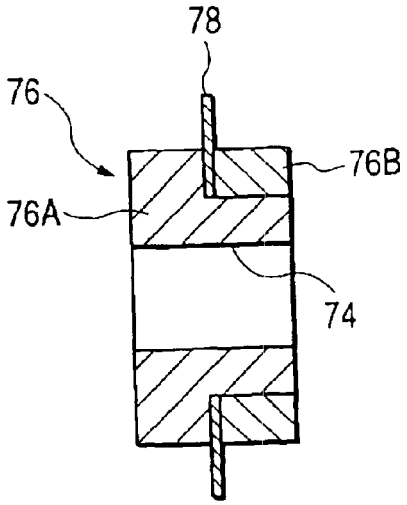
FIG. 13A is a cross sectional view showing a star wheel.

As shown in FIG. 13A, the star wheel 70 is constituted with a retaining member 76 formed with a resin having a cylindrical shape with a hole 74 formed therein, and a wheel 78 formed with stainless steel retained by the retaining member 76.

Figure 13B:
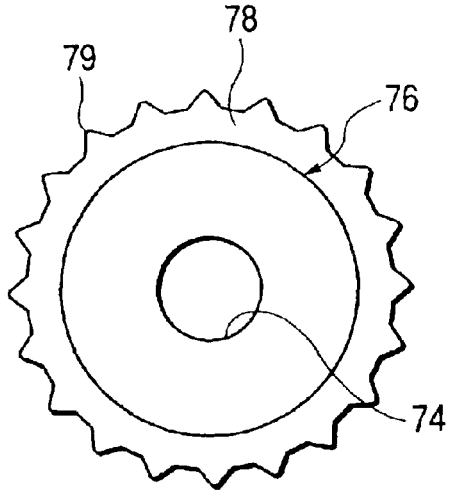
FIG. 13B is a side view thereof.
Figure 13C:
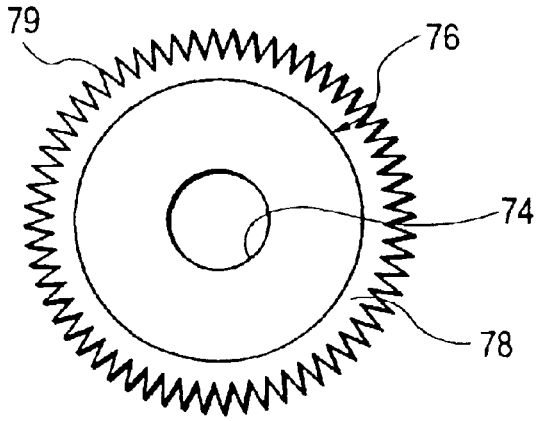
FIG. 13C is a side view of another example thereof.

The retaining member 76 is constituted with a first member 76A having a diameter reduced at a center in the axial direction to enable insertion of the wheel, and a second member 76B engaged in the part of the first member 76A having the reduced diameter to hold the wheel 78 associated with the first member 76A. The wheel 78 has a large number of teeth 79 on the outer periphery at a constant interval. The tooth 79 has an obtuse tip angle with a round tip end as shown in FIG. 13B, but such a shape is sufficient that has a reduced contact area as small as possible since it is in contact with an undried ink on the paper, and it may have, for example, an acute tip angle as shown in FIG. 13C.

The pressing force for pressing the paper with the star wheel 70 is preferably from 5 to 30 gf per one wheel, and more preferably from 10 to 20 gf per one wheel. In the case where the pressing force is less than 5 gf, the paper cannot be sufficiently suppress deformation of the paper to fail to maintain uniform the distance between the nozzle surface and the paper, and in the case where it exceeds 30 gf, the star wheel 70 damages the paper.

The function of the recording apparatus according to this embodiment thus constituted will be described.

In the ink-jet recording apparatus 200, paper is conveyed under the recording head units 40 constituting the recording head 44. The uniformizing units 202 arranged among the recording head units 40 in the width direction apply a force in the direction perpendicular to the paper to uniformize the distance between the nozzle surface 40A and the paper. Accordingly, ink droplets are discharged from the recording head units 40 to the paper having the uniform distance to the nozzle surface 40A, whereby the ink droplets impacton the paper with high accuracy to form an image with high image quality.

In the case where the paper is pressed with the pressing member 206 onto the supporting member 204 as shown in FIG. 7, the paper may be pressed with the own weight of the pressing member 206, so as to uniformize with a constant load in spite of the thickness of paper.

Figure 14A:
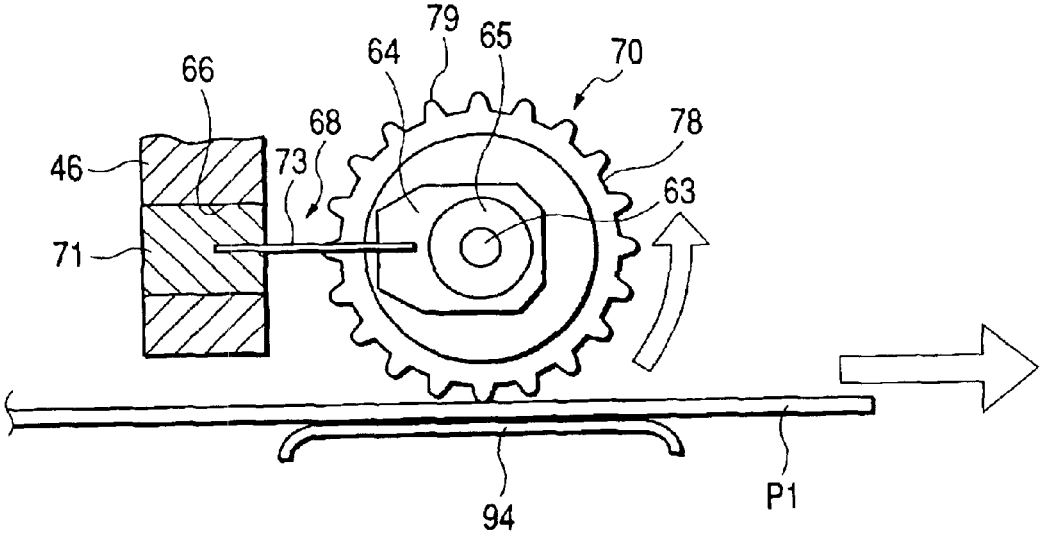
FIG. 14A is a diagram showing a pressing state of a star wheel where thin paper is conveyed.
Figure 14B:
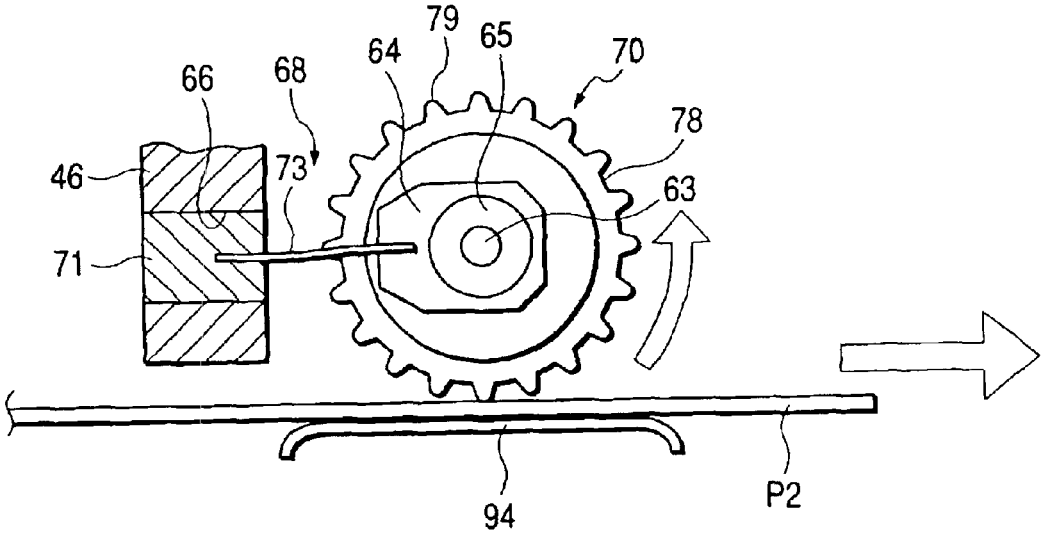
FIG. 14B is a diagram showing a pressing state of a star wheel where thick paper is conveyed.

In the case where the pressing member 206 is supported by an elastic member 208, on the other hand, the pressing member 206 supported by the elastic member 208 is pushed up with the paper conveyed between the supporting member 204 and the pressing member 206, so as to generate a pressing force onto the paper with an elastic force formed by elastic deformation of the elastic member 208. Accordingly, a large pressing force can be obtained by a relatively small member. Furthermore, an appropriate pressing force corresponding to the species of the paper and the apparatus can be set by selecting the elastic member 208. Moreover, the deformation amount of the elastic member 208 becomes larger in the case of thicker paper, and thus the elastic force (i.e., the pressing force of the pressing member 206) becomes larger. For example, in the case where the star wheel 70 is supported by the blade spring 73, the deformation amount of the blade spring 73 is increased in the case where thick paper P2 is passed, so as to form a larger elastic force in comparison to the case where thin paper P1 is passed, as shown in FIGS. 14A and 14B. Accordingly, a larger pressing force is applied to thicker paper, whereby the uniformity of the distance between the paper and the nozzle surface can be ensured even in the case of thick paper, which generally has large stiffness. Therefore, such an advantage is obtained in that the paper can be selected from a wider range.

It is preferred that a mechanism for adjusting the pressing force is provided as shown, for example, in FIG. 11, since the pressing force can be adjusted corresponding to the species of the paper and the characteristics of the apparatus.

In the case where the pressing member 206 is the star wheel 70, the contact area thereof with the paper can be suppressed to the minimum, whereby even in the case where it is in contact with the printed surface immediately after impacting ink droplets thereon, the distance to the nozzle surface can be uniformized while damage of the image thus formed is suppressed to the minimum. Furthermore, since the star wheel 70 is rotationally driven associated with the paper upon contact with the paper under pressure as shown in FIG. 14, it does not slide on the paper to suppress the influence on the printed image to the minimum.

In this embodiment, particularly, the recording head 44 is constituted with the recording head units 40 arranged in a staggered manner, and therefore, the pressing member 206 between the recording head units constituting the downstream head array 42B is in contact with a printed surface formed by impact of ink droplets from the recording head units 40 constituting the upstream head array 42A. However, the image quality can be maintained in a good condition in the case where the pressing member 206 is the star wheel 70.

Such an advantage can be also obtained in that the conveying stability of the paper is improved with the star wheel 70.

EXAMPLE

An ink-jet recording apparatus having a recording device according to an example of the invention will be described. The same constitutional elements as in the aforementioned embodiment are attached with the same symbols, and detailed descriptions thereof are omitted herein.

(Overall Constitution of Ink-jet Recording Apparatus)

The overall constitution of the ink-jet recording apparatus will be briefly described.

Figure 15:
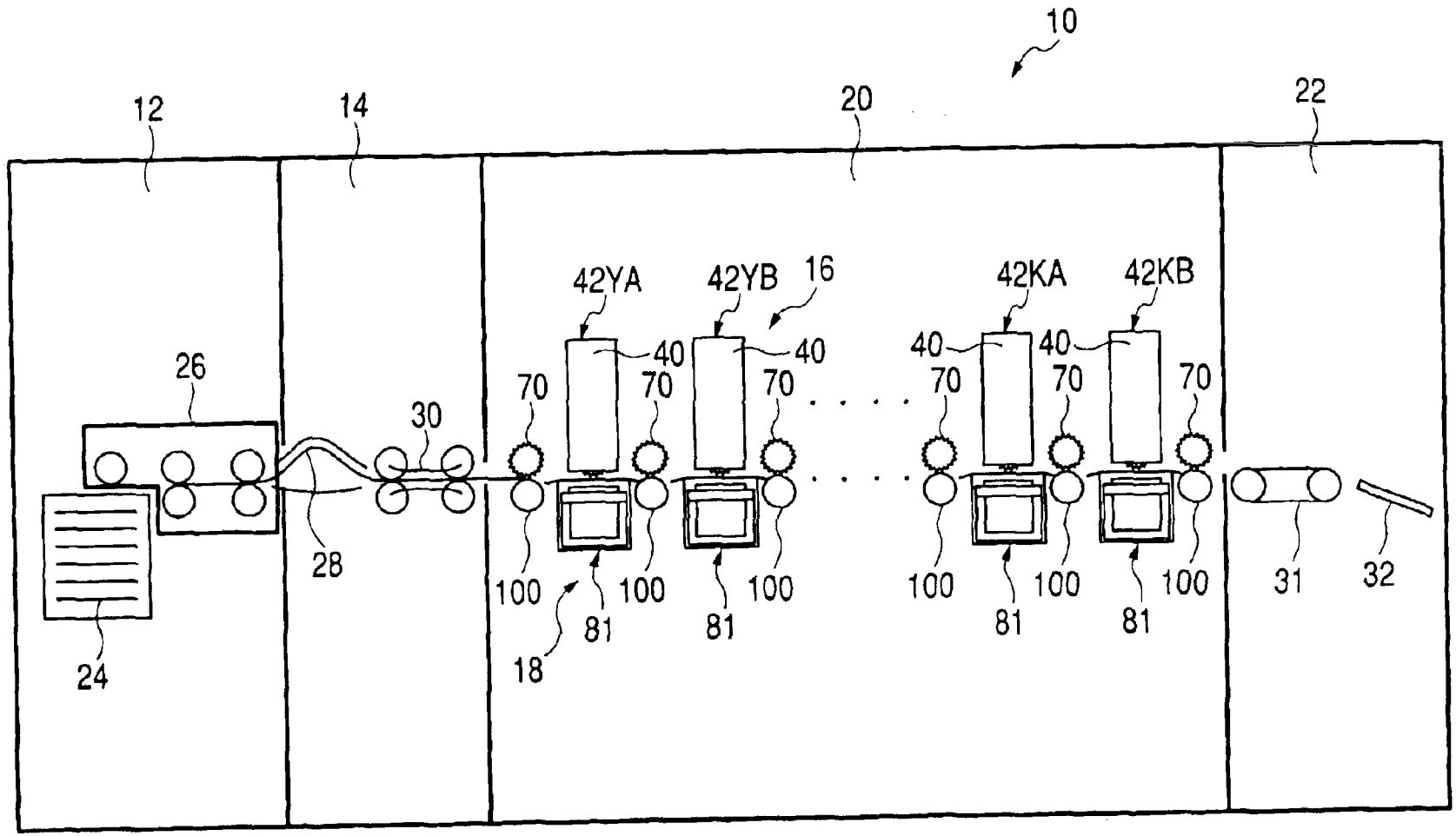
FIG. 15 is a schematic constitutional view showing a recording apparatus according to an embodiment of the invention.

As shown in FIG. 15, the ink-jet recording apparatus 10 is basically constituted with a paper feeding part 12 for dispatching paper, a registration adjustment part 14 for controlling the orientation of the paper, a recording part 20 having a recording head part 16 for forming an image on the paper by discharging ink droplets and a maintenance part 18 for carrying out maintenance of the recording head part 16, and a paper delivery part 22 for delivering the paper having an image formed thereon in the recording part 20.

The paper feeding part 12 is constituted with a stocker 24 having accumulated sheets of paper stocked therein, and a conveying device 26 for conveying a sheet of paper one by one from the stocker 24 to the registration part 14.

The registration part 14 has a loop forming part 28 and a guide member 30 for controlling the orientation of the paper, and upon passing the paper through the registration part 14, skew of the paper is corrected with stiffness of the paper, and the conveying timing is controlled to be fed to the recording part 20.

The recording part 20 has a paper conveying path, in which the paper is conveyed between the recording head part 16 and the maintenance part 18, and an image is formed on the paper, which is continuously (without stoppage) conveyed on the paper conveying path, by discharging ink droplets from the recording head part 16. Pairs of the recording head part 16 and the maintenance part 18 are unitized, respectively, and the recording head part 16 is construed as being removably from the maintenance part 18 disposed opposite thereto with the paper conveying path intervening therebetween. Therefore, in the case of paper jam, jammed paper can be easily removed. The recording part 20 will be described in detail later, and descriptions thereof are omitted herein.

The paper delivery part 22 houses the paper having an image formed in the recording part 20 in a tray 32 through a paper delivery belt 31.

(Constitution of Recording Head Part)

Figure 16:
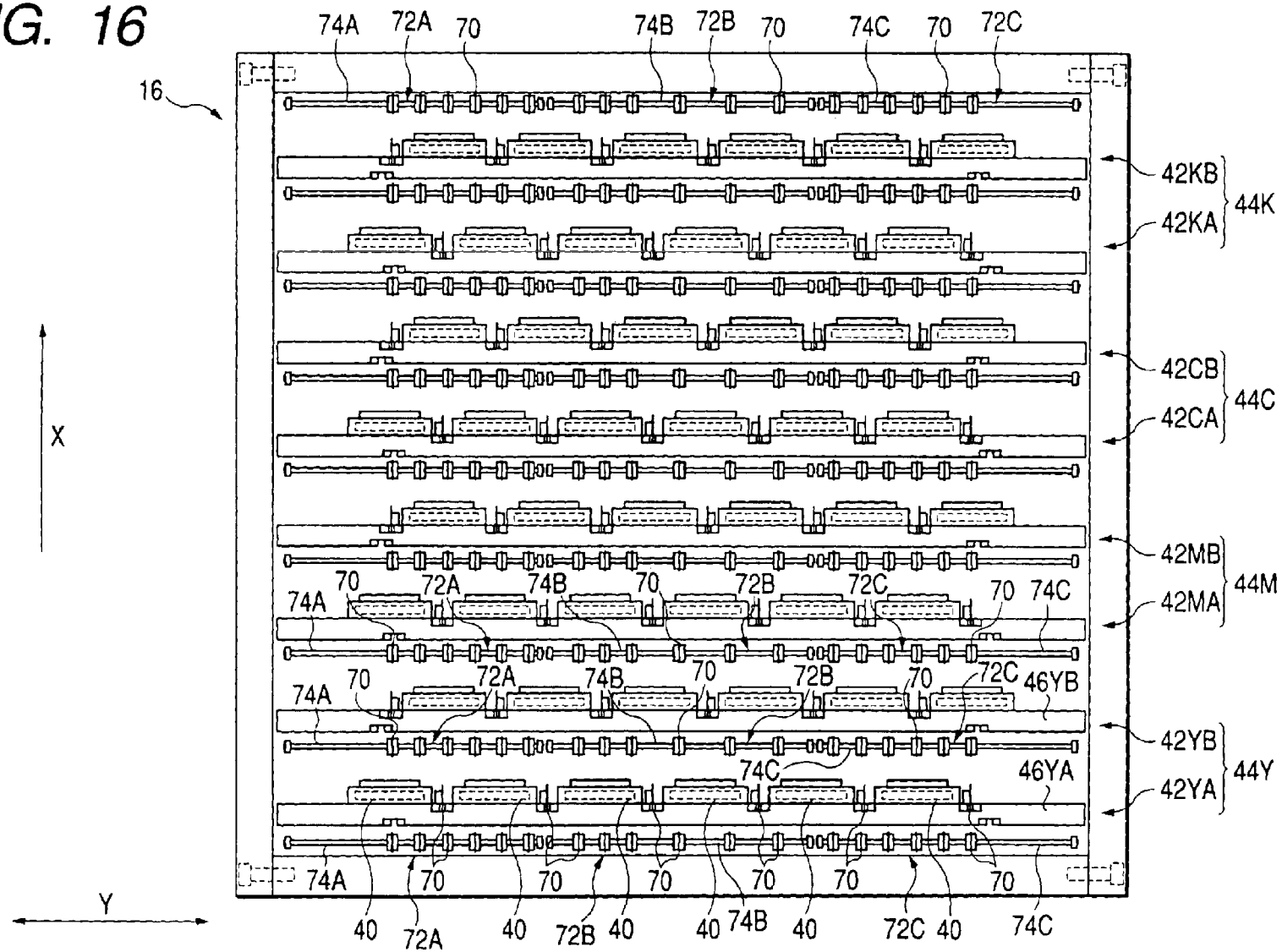
FIG. 16 is a schematic plane view showing a recording head part according to an embodiment of the invention.

The recording head part 16 will be described in detail with reference to FIGS. 16 to 21. FIG. 16 is a schematic plane view showing the recording head part viewed from above. (The plane view from above is employed for the sake of convenience upon parallelizing with FIG. 22.)

As shown in FIG. 16, the recording head part 16 basically has eight recording head arrays 42 arranged in the paper conveying direction (the direction shown by the arrow X in the figure, which is hereinafter sometimes referred to as a conveying direction) at a constant interval, and each of the recording head arrays 42 has six recording head units 40 arranged in the paper width direction (the direction shown by the arrow Y in the figure, which is hereinafter sometimes referred to as a width direction) perpendicular to the conveying direction at a constant interval.

Figure 17:
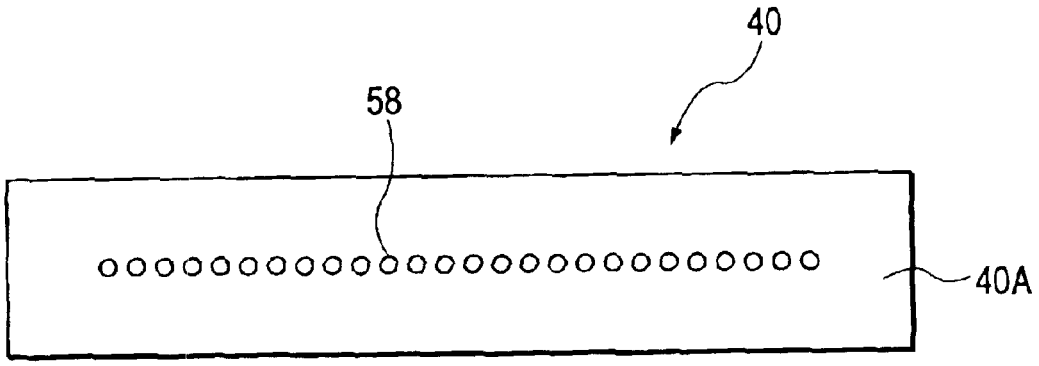
FIG. 17 is a plane view showing a recording head unit according to an embodiment of the invention.

As shown in FIG. 17, the recording head unit 40 has nozzles 58 for discharging an ink arranged in a straight form on the nozzle surface 40A, ink droplets are discharged therefrom by a known thermal ink-jet system. In this example, the recording head unit 40 has 800 nozzles with a nozzle arrangement density of 800 dpi and an ejection frequency of 7.56 kHz and uses a pigment ink.

Six recording head units 40 are attached to a common substrate 46, which will be described later, in a straight form in such a manner that the arranging direction of the recording head units 40 agrees with the width direction, so as to form the recording head arrays 42A and 42B.

Figure 18:
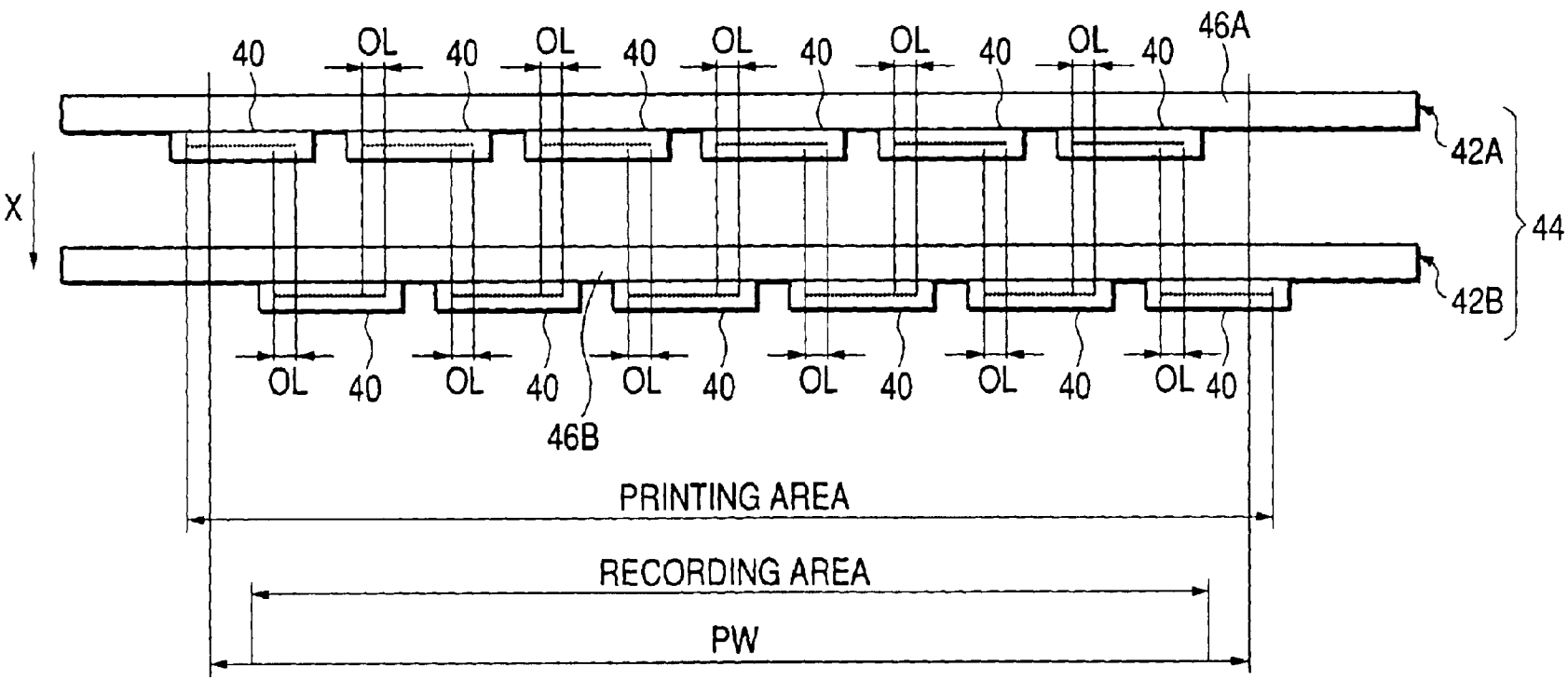
FIG. 18 is a constitutional explanatory view showing a recording head array according to an embodiment of the invention.

As shown in FIG. 18, the recording head arrays 42A and 42B each has six recording head units 40 arranged at a constant interval, and the arrangement of the recording head units 40 is deviated between the recording head arrays 42A and 42B, whereby a part of the nozzle rows of the recording head units 40 is disposed so as to have an overlap region OL which overlaps each other between the recording head arrays 42A and 42B. The overlapping areas OL thus provided prevent formation of a non-printing area in the printing area. The nozzles 58 of the recording head units 40 of the pair of recording head arrays 42A and 42B eject ink droplets to print an image of one color on the paper. In this example, a combination of the pair of recording head arrays 42A and 42B is referred to as a recording head 44.

The recording head 44 of this example has a printing area of 12 inches, which is wider than 297 mm, the shorter width of A3 size paper (i.e., the longer width of A4 size paper), as the maximum paper width PW.

The recording heads 44 are arranged to print images of yellow (Y), magenta (M), cyan (C) and black (K) from the upstream of the conveying direction to attain full color printing, and symbols, Y, M, C and K, are attached to the reference numbers of the corresponding recording head (i.e., 44Y, 44M, 44C and 44K) depending on necessity to distinguish the recording heads, as shown in FIG. 16. The nomenclature is also applied to the other members.

In FIG. 16, because the recording heads 44Y, 44M, 44C and 44K have the same constitution, only constitutional elements of the recording head 44Y are attached with reference symbols, and reference symbols for constitutional elements of the other recording heads 44M, 44C and 44K are omitted.

Figure 19:
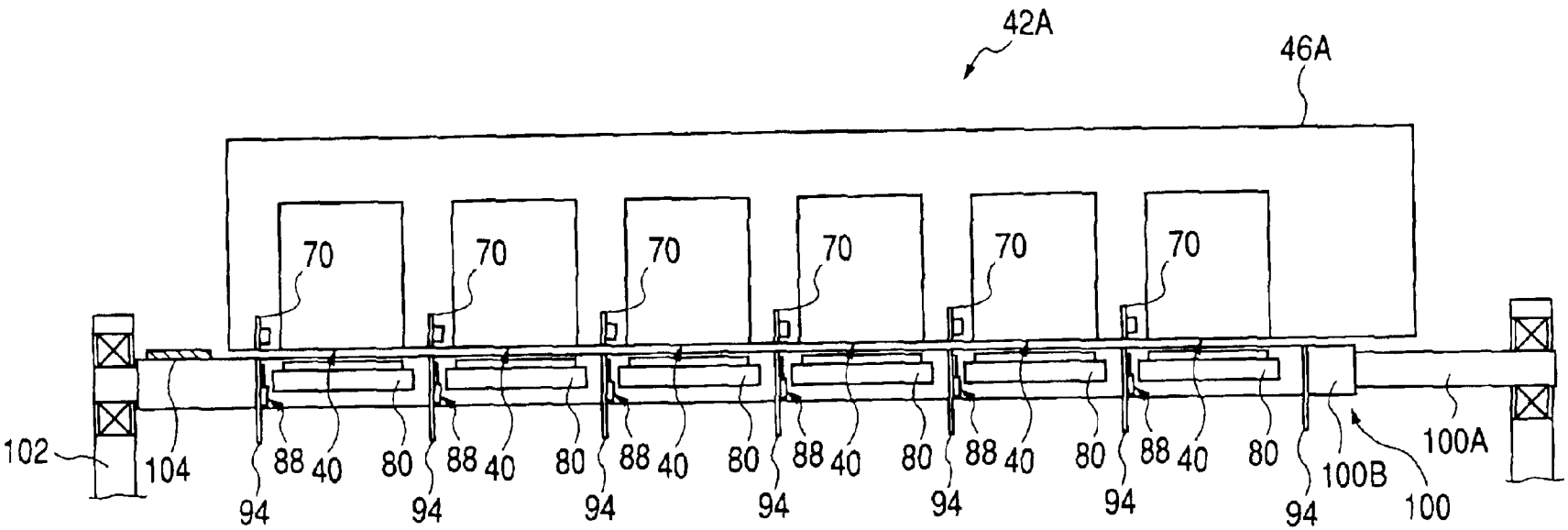
FIG. 19 is a vertical cross sectional view showing a recording part according to an embodiment of the invention.

As shown in FIG. 19, the recording head array 42A constituting the recording head 44 has six recording head units 40 attached at a prescribed interval to the common substrate 46A extending in the paper width direction.

In other words, the recording head units 40 are attached to the common substrate 46A, whereby the rows of nozzles are arranged in the width direction as shown in FIG. 18.

Figure 20:
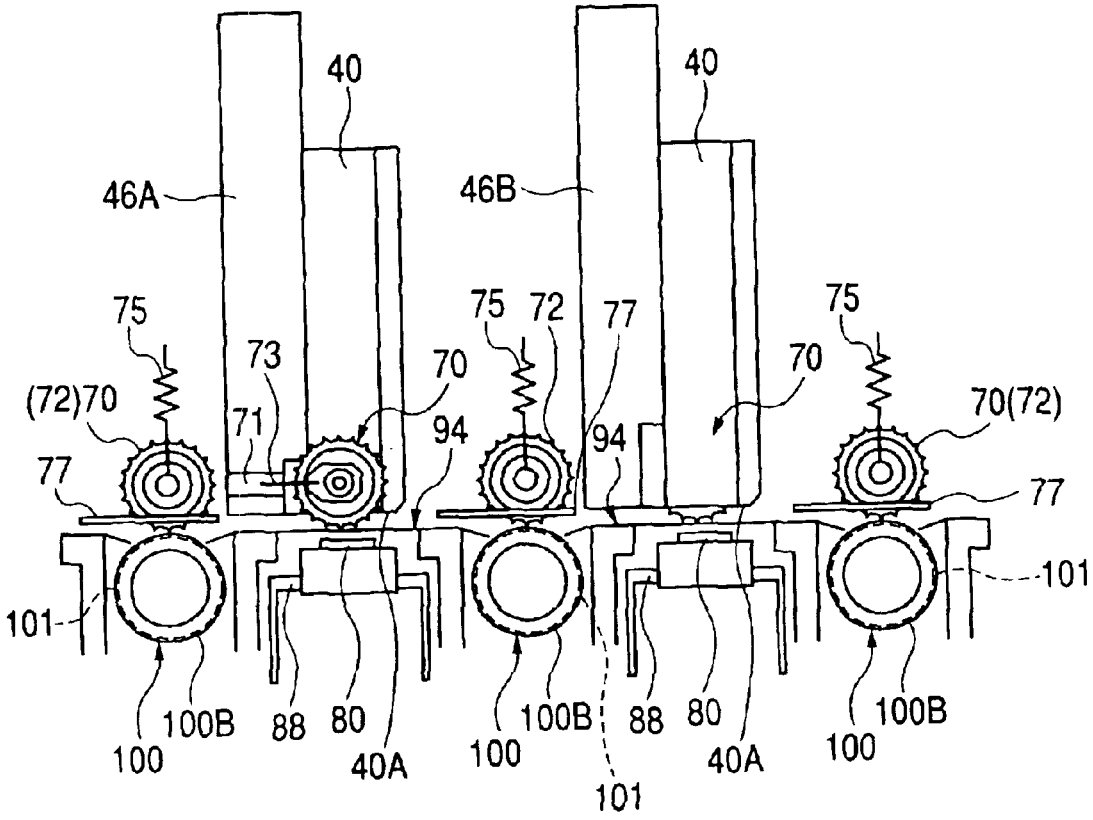
FIG. 20 is a side view of an important part of a recording part according to an embodiment of the invention.

The recording head array 42A also has star wheels 70 adjacent in the width direction to the respective recording head units 40. The star wheel 70 is pivotally supported elastically at a tip end of a supporting member 71, which is engaged with the common substrate 46A through a blade spring 73, as shown in FIG. 20.

Figure 21A:
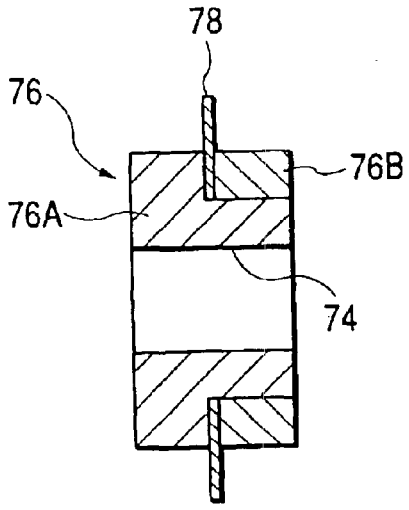
FIG. 21A is a cross sectional view showing a star wheel.

As shown in FIG. 21A, the star wheel 70 is constituted with a retaining member 76 formed with a resin having a cylindrical shape with a hole 74 formed therein, and a wheel 78 formed with stainless steel retained by the retaining member 76.

Figure 21B:
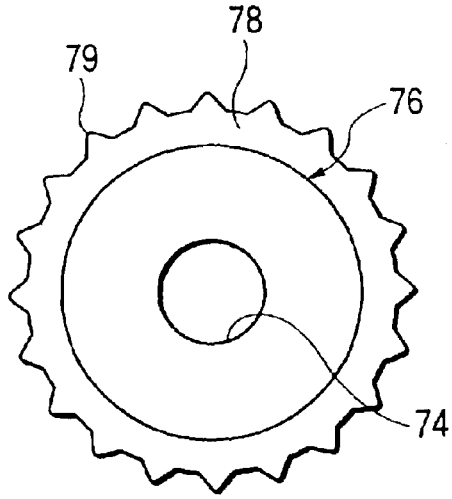
FIG. 21B is a side view thereof.
Figure 21C:
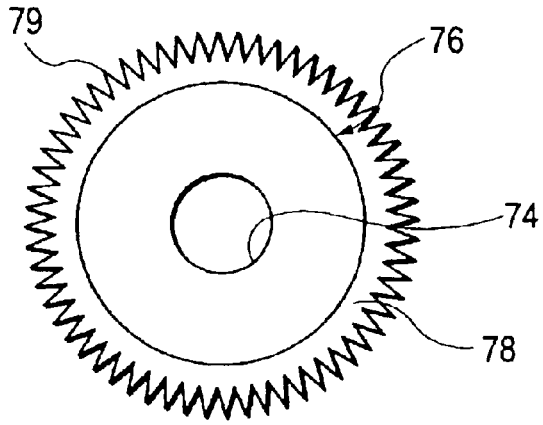
FIG. 21C is a side view of another example thereof.

The retaining member 76 is constituted with a first member 76A having a diameter reduced at a center in the axial direction to enable insertion of the wheel, and a second member 76B engaged in the part of the first member 76A having the reduced diameter to hold the wheel 78 associated with the first member 76A. The wheel 78 has a large number of teeth 79 on the outer periphery at a constant interval. The tooth 79 has an obtuse tip angle with a round tip end as shown in FIG. 21B, but such a shape is sufficient that has a reduced contact area as small as possible since it is in contact with an undried ink on the paper, and it may have, for example, an acute tip angle as shown in FIG. 21C.

The thickness of the wheel 78 in this example is 0.1 mm, which is thinned by tapering to about from 0.01 to 0.02 mm at the tip end (tooth top) thereof. The wheel 78 is produced with a stainless steel material, SUS631EH, through stepwise etching on both surfaces to process the tip end shape and the taper shape simultaneously, and has a fluorine resin water-repellent coating on the surface.

In the recording head part 16, groups of three star wheels 72A to 72C are arranged among the recording head arrays 42 along the conveying direction, on the upstream of the most upstream recording head array 42YA, and on the downstream of the most downstream recording head array 42KB, as shown in FIG. 16. The groups of star wheels 72A to 72C each has six star wheels 70 pivotally supported with a prescribed interval by three shafts 74A to 74C, which are continuously arranged in the width direction. The shafts 74A to 74C are energized on both ends thereof with a spring 75 to a conveying roll 100 described later. The displacement amount of the star wheel 70 is restricted with a restriction member 77 to such an extent that the star wheel 70 is stopped at a position slightly breaking into the surface of the conveying roll 100 as shown in FIG. 20.

The intervals of the star wheels 70 in the width direction are determined at 25.4 mm at most. This is because it is preferably 50 mm or less in order to floatage and deformation locally occurring in the paper.

The force for pressing the star wheel 70 onto the conveying roll 100 with the spring 75 is 10 gf per one wheel. In the case where the pressing force is less than 5 gf, the paper cannot be sufficiently held on the conveying roll 100, and in the case where it exceeds 30 gf, the star wheel 70 damages the paper.

(Constitution of Maintenance Part)

Figure 22:
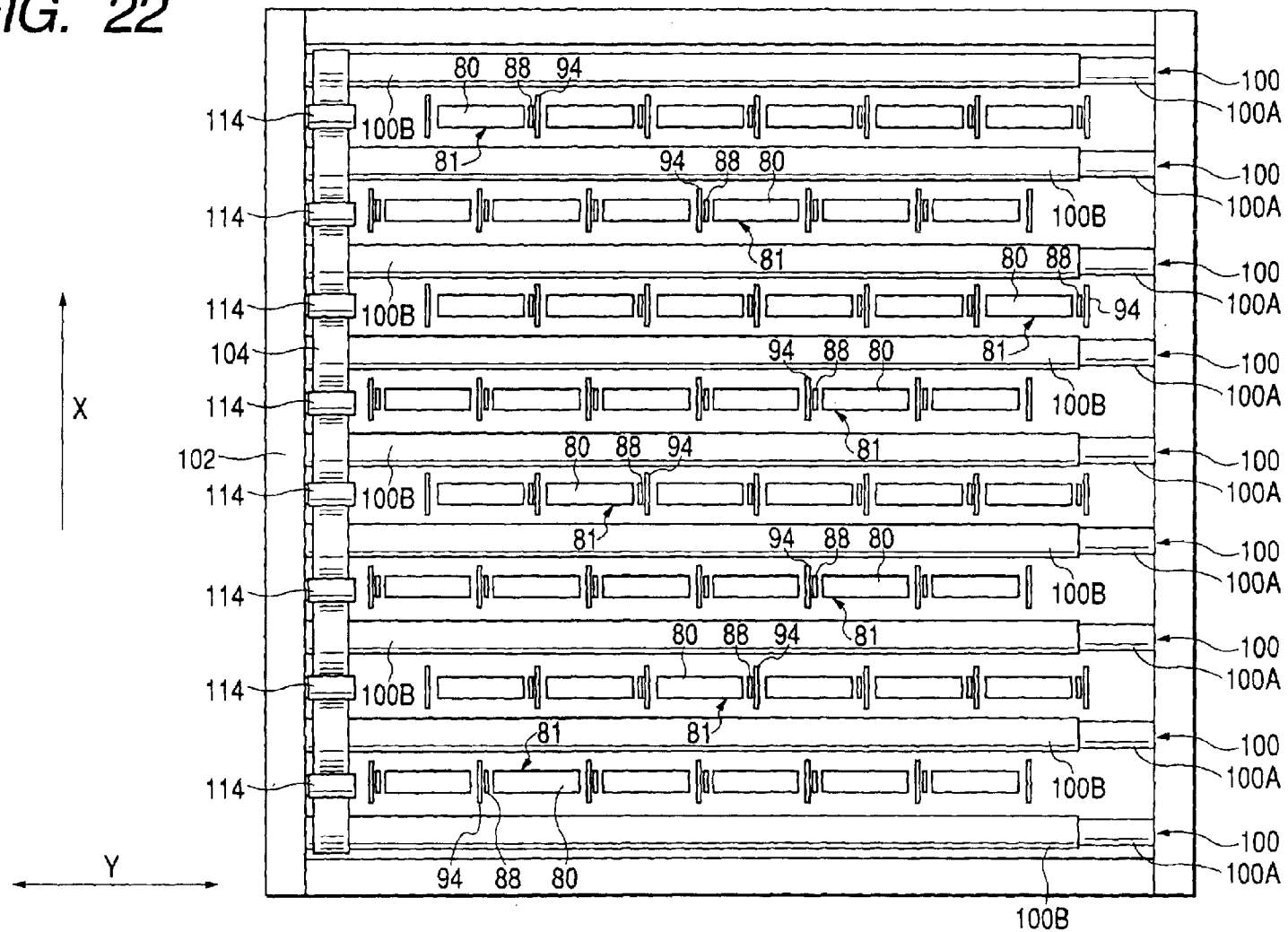
FIG. 22 is a schematic plane view showing a maintenance part according to an embodiment of the invention.

The constitution of the maintenance part 18 disposed opposite to the recording part 20 will be described with reference to FIGS. 22 to 27. FIG. 22 is a schematic plane view showing the maintenance part 18 viewed from the conveying position.

The maintenance part 18 is disposed opposite to the recording part 20 with the paper conveying position intervening therebetween, and as shown in FIG. 22, it has maintenance devices 81 arranged at positions opposite to the respective recording head units 40 of the recording part 20 as shown in FIG. 16. The maintenance device 81 is constituted with a cap member 80 and a wiping member 88.

Figure 23:
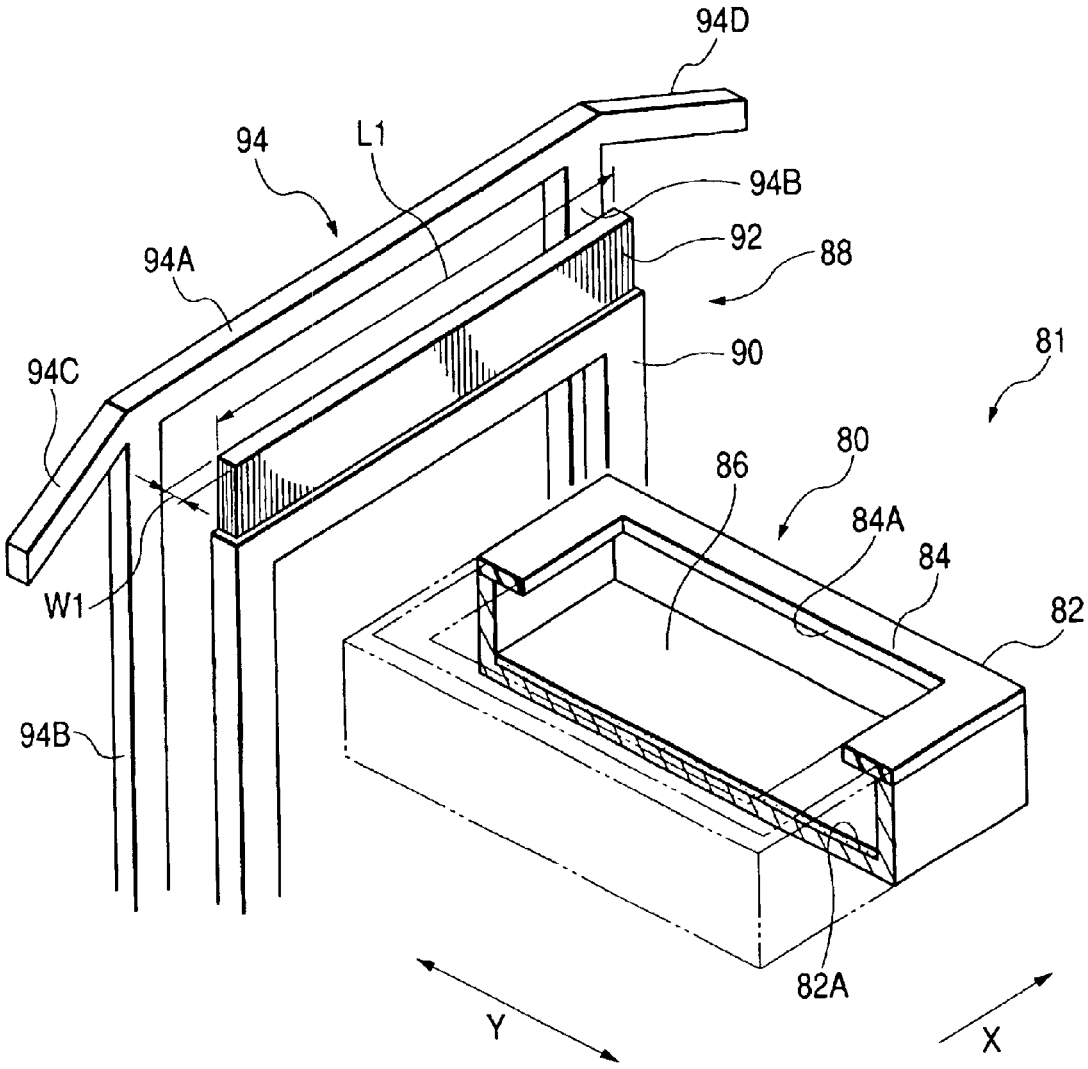
FIG. 23 is a perspective view showing an important part of a maintenance part according to an embodiment of the invention.

As shown in FIG. 23, the cap member 80 is constituted with a receiving member 82 formed with a PBT resin having a concave part 82A of a rectangular shape with a depth of 8 mm, a rubber member 84 formed with silicone rubber (having a hardness of 40 Hs) on an upper part of the receiving member 82, and an ink absorbent 86 formed with polypropylene and polyethylene disposed over the bottom of the concave part 82A. Therefore, upon carrying out dummy jet described later, ink droplets are discharged from the nozzles 58 of the respective recording head units 40 to the interior of the concave part 82A through an opening 84A of the cap member 80, and are absorbed with the ink absorbent 86.

Figure 24:
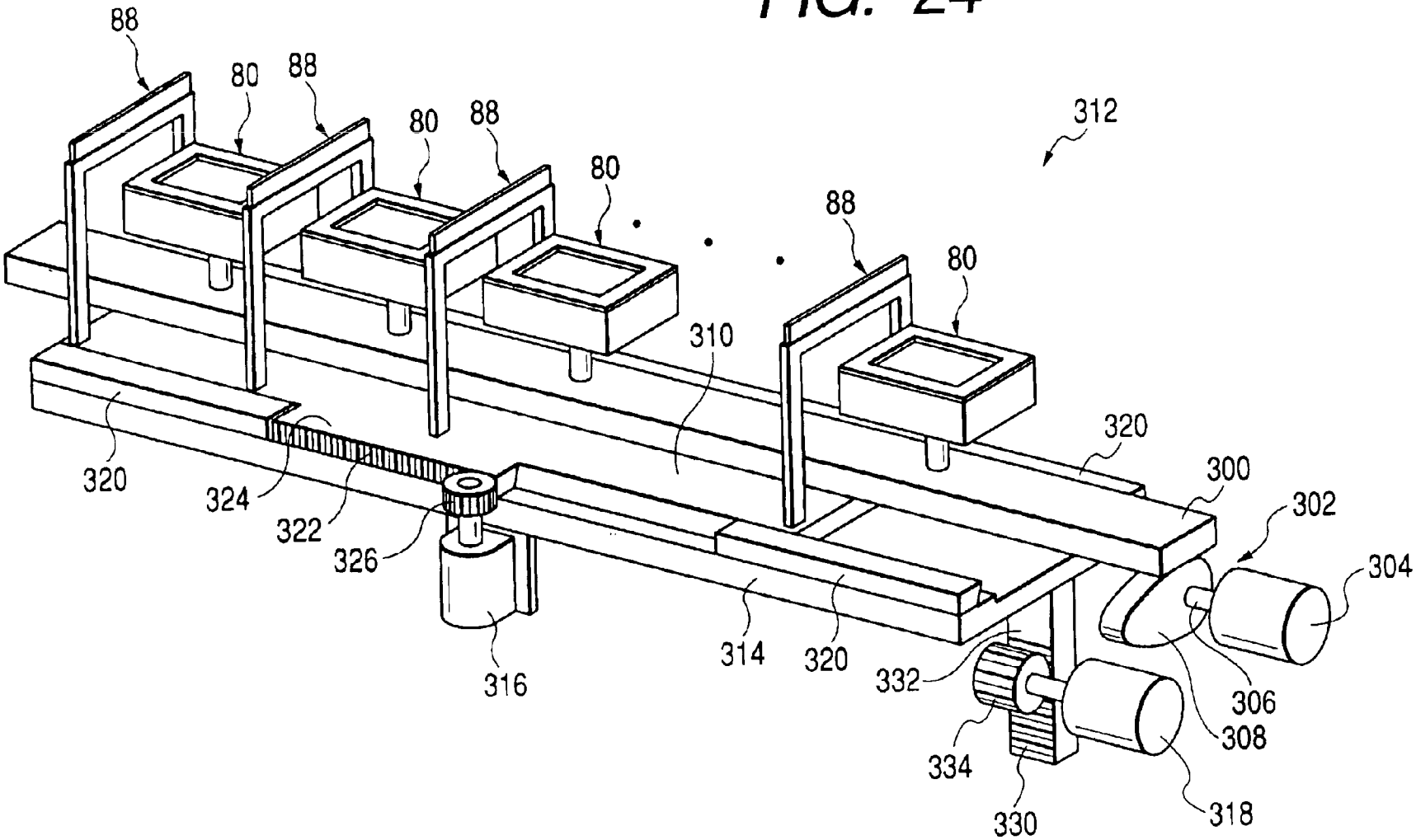
FIG. 24 is a perspective view showing an elevating mechanism and a moving mechanism of a maintenance part according to an embodiment of the invention.

As shown in FIG. 24, six cap members 80 corresponding to the recording head units 40 constituting the recording head array 42 are attached to a common substrate 300 and unitized, and they are constituted as they can integrally approaching to and leaving from the nozzle surface 40A of the recording head unit 40 with an elevating mechanism 302.

The elevating mechanism 302 is constituted with a driving motor 304 and an eccentric cam 308 attached to a driving axis 306 of the driving motor 304 and in contact with a lower surface of the common substrate 300. Accordingly, the eccentric cam 308 is rotated upon driving the driving motor 304, and thus the common substrate 300 in contact with the eccentric cam 308 approaches to and leaves from the nozzle surface 40A of the recording head unit 40.

The cap member 80 has, on the lower surface thereof, a spring 87 for adjusting the pressing force upon contacting with the nozzle surface 40A as shown in FIG. 28. Accordingly, upon capping operation described later, the cap member 80 rises, and the rubber member 84 is pressed onto the nozzle surface 40A to seal the nozzle surface 40A including the nozzles 58, whereby drying of the ink is suppressed, and attachment of dusts is prevented. Furthermore, upon wiping operation described later, the cap member 80 descends, whereby the wiping member 88 is made movable in the width direction.

The wiping member 88 for cleaning the nozzle surface 40A of the recording head unit 40 is disposed at a position adjacent in the width direction to the cap member 80 as shown in FIGS. 23 and 24.

As shown in FIG. 23, the wiping member 88 is constituted with a retaining member 90 having a substantially gantry shape as viewed from the width direction, and a wiper 92 disposed on an upper part of the retaining member 90 and extending in the conveying direction.

The wiper 92 is formed with a thermoplastic polymer resin (having a hardness of 65 Hs) and has a length in the conveying direction L of 8 mm, a width in the thickness direction W1 of 0.8 mm and a height from the retaining member 90 (free length) of 6 mm.

The retaining member 90 is formed with a stainless steel material.

The wiping member 88 is disposed at a position at 1 mm from the end of the cap member 80 in the width direction.

As shown in FIG. 24, all the wiping members 88 corresponding to the respective recording head units 40 constituting the recording head array 42 are attached to a common substrate 310 and unitized, and they can integrally approaching to and leaving from the nozzle surface 40A of the recording head unit 40 and are movable in the width direction with a moving mechanism 312.

The moving mechanism 312 is basically constituted with a slider 314 supporting the common substrate 310 movably in the width direction, a driving motor 316 for moving the common substrate 310 on the slider 314 in the width direction, and a driving motor 318 for elevating the slider 314. The slider 314 has guides 320, which are provided on both ends in the conveying direction and extend in the width direction, and the common substrate 310 guided with the guides 320 is movable in the width direction. Protrusions 324 constituting a rack 322 are formed on one side surface of the common substrate 310, with which a driving gear 326 of the driving motor 316 attached to the slider 314 is engaged. Accordingly, the common substrate 310 is movable on the slider 314 in the width direction by driving the driving motor 316.

Protrusions 332 constituting a rack 330 extending in the vertical direction are provided on a lower surface of the slider 314, with which a driving gear 334 of the driving motor 318 is engaged. Accordingly, the slider 314 can be elevated by driving the driving motor 318. That is, the common substrate 310 and wiping members 88 supported by the slider 314 are integrally elevated.

Figure 25A:
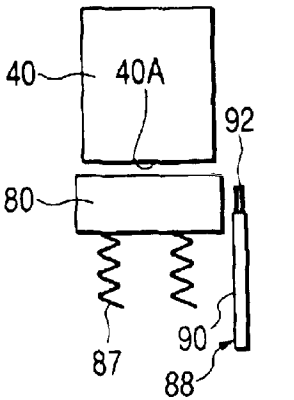
FIGS. 25A to 25G are operational explanatory views showing wiping operation in a recording apparatus according to an embodiment of the invention.
Figure 25B:
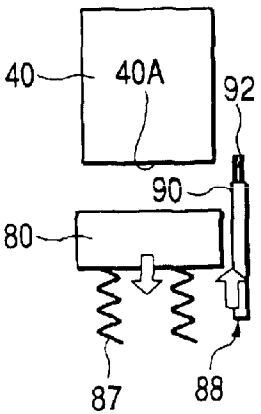
Figure 25C:
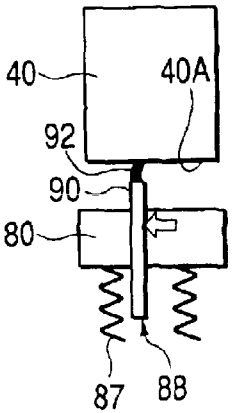

According to the constitution, the wiping members 88 can approach to and leave from the nozzle surface 40A (i.e., can be elevated) and are movable in the width direction with the moving mechanism 312. That is, the wiping member 88 (wiper 92) in the home position is disposed at a position lower than the cap member 80 to prevent from interfering the paper thus conveyed (as shown in FIG. 25A), and upon wiping, it rises and moves in the conveying direction by overstriding the cap member 80 thus descending from the home position to effect wiping (as shown in FIG. 25C).

In order to prevent the paper penetrating into the concave part 82A of the cap member 80 upon conveying the paper in the recording part 20, guide members 94 are provided on both sides of the cap member 80 in the width direction as shown in FIG. 23. The guide member 94 is formed with a stainless steel material and constituted with a horizontal part 94A extending in the conveying direction, two vertical parts 94B extending from both ends of the horizontal part 94A in the vertical downward direction, and guide parts 94C and 94D extending from both ends in the conveying direction of the horizontal part 94A in the obliquely downward direction toward the conveying direction.

The horizontal part 94A of the guide member 94 is disposed opposite to the star wheel 70 disposed between the recording head units as shown in FIGS. 16, 22 and 20). Accordingly, the paper thus conveyed is in contact with the guide member 94 (horizontal part 94A) by the star wheel 70 at the printing position in the conveying direction, whereby the distance between the nozzle surface 40A and the paper deformed by attachment of an ink or the like is maintained constant as shown in FIG. 20.

Subsequently, the home position of the respective members constituting the maintenance device 81 in this example (i.e., the position where no maintenance is carried out on the recording head unit 40 during image printing) will be described.

The cap member 80 is disposed under the nozzle surface 40A of the recording head 40, whereby the rubber member 84 covers, in plane view, the entire nozzle surface 40A of the recording head unit 40, and all the nozzles 58 of the recording head unit 40 are positioned, in plane view, within the opening 84A of the rubber member 84.

The wiping member 88 is disposed in such a manner that the tip end of the wiper 92 is positioned under the nozzle surface of 40A of the recording head unit 40, and disposed at such a position in that the longitudinal direction (in the conveying direction) of the wiper 92 covers, in plane view, the entire width in the conveying direction of the nozzle surface 40*a* of the recording head unit 40, and the wiper 92 is placed at a position apart from the end in the width direction of the recording head unit 40 by 1 mm (i.e., such a position in that the wiper can clean the recording head in the shorter width direction thereof).

The guide member 94 is disposed in such a manner that the uppermost surface of the horizontal part 94A, which is in contact with the paper, is positioned under the nozzle surface 40A of the recording head unit 40, and disposed at such a position in that the longitudinal direction in the conveying direction of the horizontal part 94A of the guide member 94 covers, in plane view, the nozzle surface 40A of the recording head unit 40, and the uppermost surface of the horizontal part 94A, which is in contact with the paper, is placed at a position apart from the end in the width direction of the recording head unit by 2 mm.

Subsequently, a mechanism for conveying the paper between the maintenance device 81 and the recording head unit 40 will be described.

Conveying rolls 100 for conveying the paper by transmitting a driving force thereto are disposed at both ends in the conveying direction and between the cap members 80 adjacent to each other in the conveying direction in the maintenance part 18 as shown in FIG. 22. The conveying rolls 100 are disposed as corresponding to the disposed positions of the groups of star wheels 72A to 72C as shown in FIG. 20, and the paper is made in contact with the conveying rolls 100 with the star wheels 70 of the groups of star wheels 72A to 72C, which are elastically pressed onto the side of the conveying rolls 100 with the springs 75, so as to transmit the driving force from the conveying rolls 100 to the paper.

The conveying roll 100 is constituted with a small diameter part 100A supported pivotally with a casing 102, and a large diameter part 10B, which has a larger diameter than the small diameter part 100A and is in contact with the star wheel 72, as shown in FIG. 19. The conveying roll 100 transmits the driving force to the paper through the large diameter part 100B, and is preferably those that have a large friction coefficient and are difficultly worn. The conveying roll 100 in this example is constituted with a metallic roll (SUS303) with a diameter of 10 mm having ceramic fine powder mainly containing alumina spray-coated thereon, followed by sintering, and satisfies the aforementioned requirements. The spray-coating is applied not only to the printing area of the large diameter part 100B of the conveying roll 100, which is in contact with the paper, but also to the non-printing area thereof, which is in contact with a flat belt 104.

In order to prevent the tooth tops of the star wheel 70 from being deformed by contacting with the surface of the conveying roll 100, a groove 101 having a width of 2 mm and a depth of 2 mm is provided at a part of the conveying roll 100 opposite to the star wheel 72 as shown in FIG. 20. Furthermore, in order to prevent the paper conveying resistance from being increased upon increasing the penetrating amount of the star wheel 72 into the groove 101, a restriction member 77 for restricting the penetrating amount of the star wheel 72 is provided as shown in FIG. 20.

Figure 26:
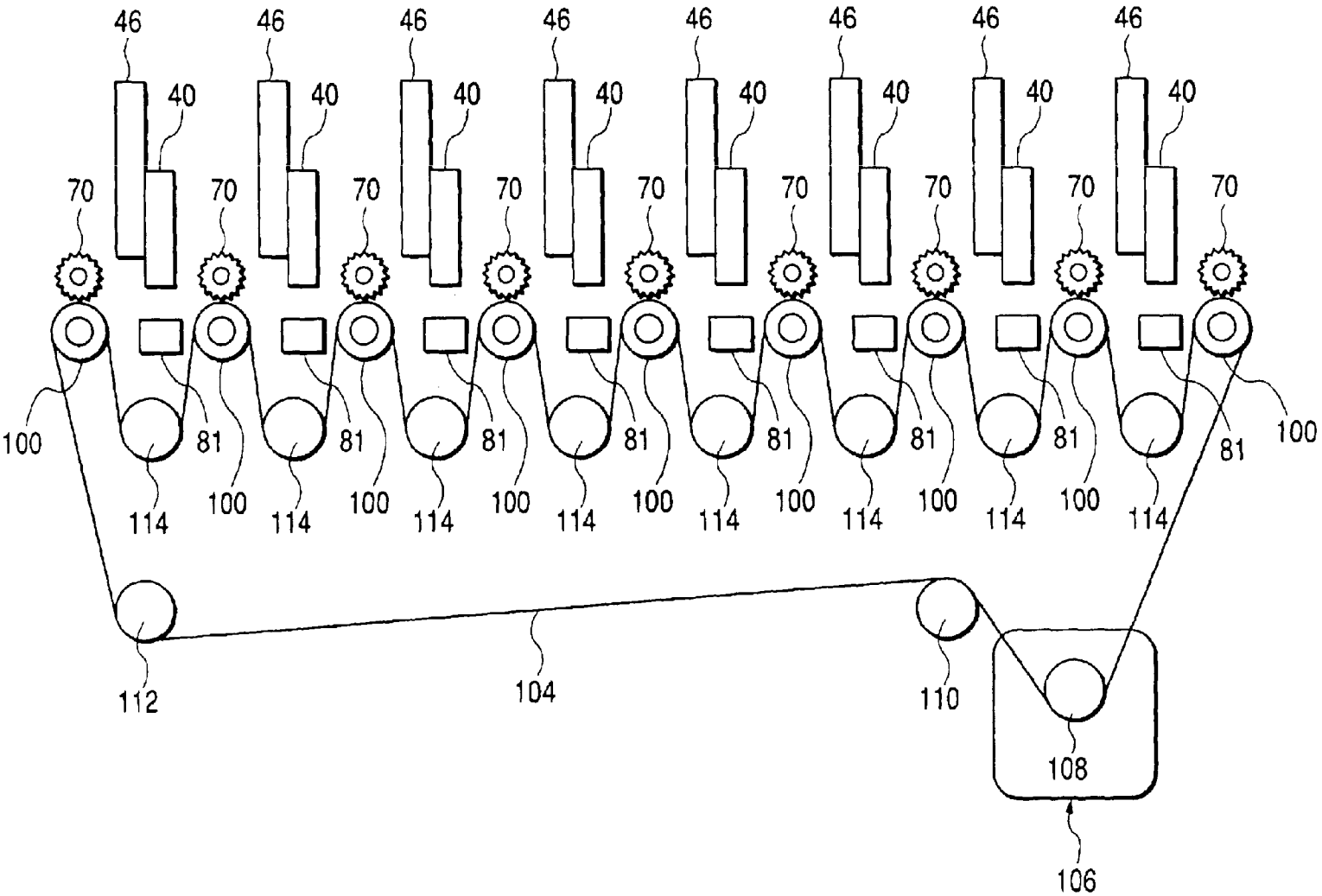
FIG. 26 is an explanatory view showing a driving mechanism of a recording apparatus according to an embodiment of the invention.

As shown in FIG. 26, the driving mechanism for driving the conveying rolls 100 is constituted in such a manner that a flat belt 104 is stretched and wound on a driving shaft 108 of a single motor 106 to all the conveying rolls 100 through idler rolls 110 and 112. Idler rolls 114 are disposed between the conveying rolls 100 adjacent to each other to ensure a wound angle of the flat belt on the respective conveying rolls 100 (large diameter parts 100B).

Figure 27:
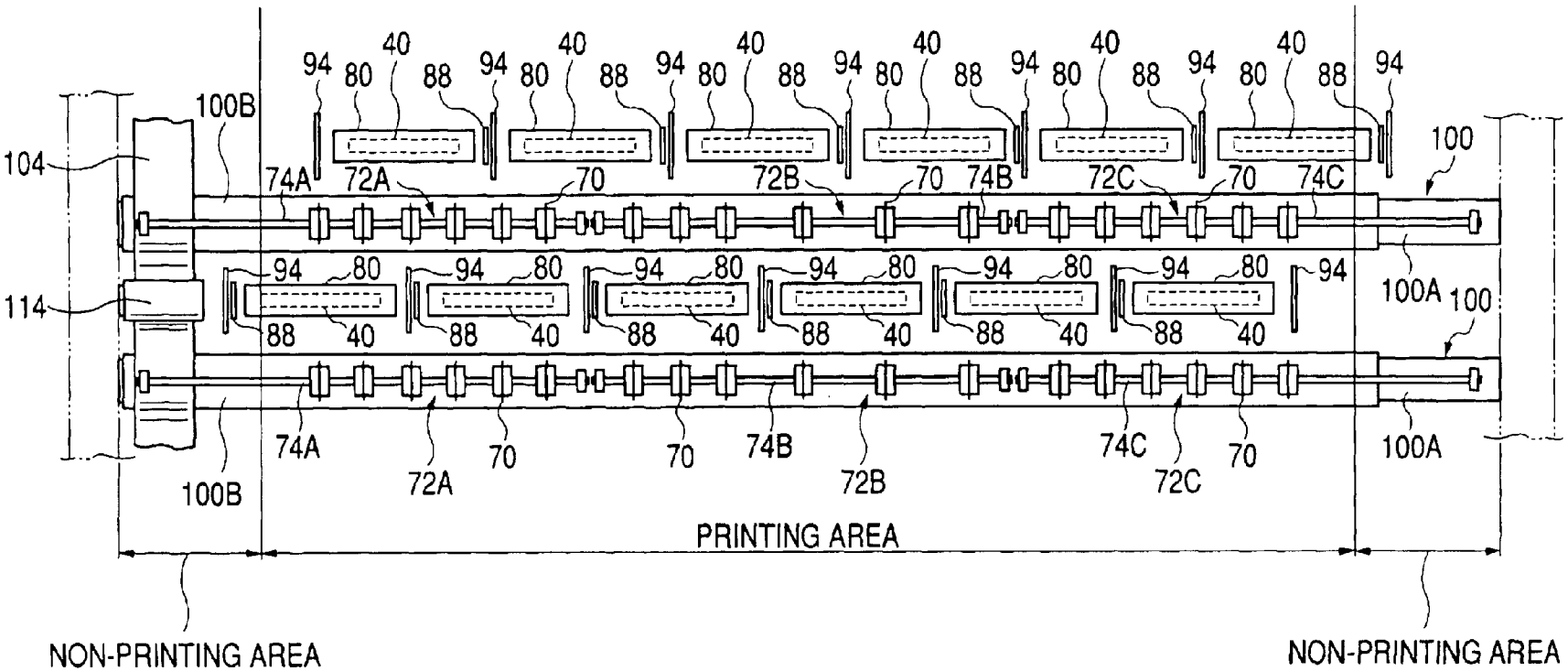
FIG. 27 is a plane view showing an important part a paper conveying mechanism according to an embodiment of the invention.

As shown in FIG. 27, the flat belt 104 is wound on the non-printing area outside the printing area in the large diameter part 100B of the conveying roll 100, with which the paper is in contact.

The single motor 106 is employed because of the following reason. In the case where plural motors are employed, the driving velocity and the fluctuation characteristics thereof of the respective motors are difficult to be made uniform, and as a result, the fluctuation components in velocity are accumulated on the paper velocity, whereby the velocity fluctuation of the paper causes problems by accumulation of the velocity fluctuation of the motors even though the velocity fluctuation of the respective motors is sufficiently low. That is, the plural conveying rolls 100 are driven by the single driving source (i.e., the motor 106), whereby the conveying velocity of the paper is made uniform to attain printing with high quality.

The flat belt 104 transmits the driving force to the conveying rolls 100 without engagement of teeth (with a frictional force), and therefore, it is particularly preferred since no periodical velocity fluctuation by every teeth occurs.

The flat belt 104 in this example has a thickness of 0.4 mm and is constituted with a base material formed by weaving polyester fibers having a thin film coating of polyurethane formed on one surface thereof, so as to attain both high mechanical strength and high friction.

According to the recording part 20 thus constituted in this example, the distance between the nozzle surface and the paper is designed to be 1.5 mm, and the paper is horizontally conveyed between them. The maximum recording area (i.e., the maximum paper width PW), to which the printing operation is applied, is a shorter width of A3 size paper (i.e., the longer width of A4 size paper). The recording part 20 has a process velocity of 240 mm/s, a printing resolution of 800×800 dpi, and a recording speed of 60 sheets per minute (in the case of long edge feed of A4 size paper (A4LEF).

The function of the ink-jet recording apparatus 10 thus constituted as described in the foregoing will be described.

The printing operation and the maintenance operation (dummy jet, wiping and capping) will be sequentially described.

The printing operation will be firstly described.

Upon carrying out the printing operation, paper is fed from the paper feeding part 12, and after controlling the orientation and the timing of the paper in the registration adjustment part 14, the paper is dispatched to the recording part 20.

In the recording part 20, the motor 106 is driven, and the driving force is transmitted to all the conveying rolls 100 through the flat belt 104.

Accordingly, the paper reaching the recording part 20 is inserted between the conveying roller 100 and the group of star wheels 72A to 72C disposed at the most upstream position in the conveying direction. At this time, the star wheel 70 of the group of star wheels 72A to 72C energized with the spring 75 presses the paper onto the conveying roll 100, whereby the conveying force is certainly transmitted from the conveying roll 100 to the paper, and thus the paper is inserted into the lower part of the recording head unit 40 at a constant velocity. Subsequently, the driving force is sequentially transmitted from the conveying rolls 100 between the recording head arrays 42 to convey the paper.

Because all the conveying rolls 100 are driven with the single motor 106, the paper is conveyed at a constant velocity, but it is prevented that accumulated velocity fluctuation of plural driving sources causes fluctuation of the conveying velocity of the paper as in the case where the conveying rolls are driven with plural driving sources. Periodic velocity fluctuation causing an image defect that can be visually recognized on an image is often caused by a problem on processing accuracy of teeth of gears, but because the flat belt 104 is used in this example for transmitting the driving force (without the use of engagement of teeth), such an image defect is prevented from occurring. Furthermore, because the flat belt 104 is wound on the non-printing area of the large diameter part 100B of the conveying roll 100 in contact with the paper, no velocity fluctuation occurs even in the case where the conveying roll 100 causes eccentricity due to the processing accuracy or the retaining system (such as bearings), and thus the paper is conveyed at the moving velocity (constant velocity) of the flat belt 104. In the constitution where the idler roll 114 is disposed to ensure the wound angle of the flat belt 104, periodic velocity fluctuation occurs due to the processing accuracy or the retaining system of the idler roll 114 in the strict sense, but the idler roll 114 can be easily processed with high accuracy at low cost because it has a relatively small size and may be formed with a single material. The conveying roll 100, on the other hand, has a large size and has a constitution containing plural materials including, for example, the core metal and the covering material, and therefore, it is difficult to be processed with high accuracy or becomes a considerably expensive member. The driving system using surface friction with the flat belt 104 has such an effect that even in the case where fluctuation in the radius and the rotational center of the conveying roll 100 occurs, no periodic fluctuation in velocity is caused thereby.

Furthermore, because the group of star wheels 72A to 72C are divided into three parts in the width direction to reduce the length of the shafts 74A to 74C thereof, deflection of the shafts can be prevented to press the paper evenly with the plural star wheels 70 energized with the springs 75. Accordingly, the driving force can be evenly transmitted to the paper.

In particular, because the paper is pressed onto the conveying roll 100 with the star wheels 70, the driving force is certainly transmitted to the paper to ensure conveying at a constant velocity. Owing to the nonuse of an electrostatic sorption system, stable conveying can be attained irrespective to the thickness and the material of the paper.

Moreover, because the star wheel 70 is disposed between the recording head units 40, and the guide member 94 is disposed at a position opposite thereto, floatage and the like of the paper can be prevented at the printing position (at the recording head array 42) in the conveying direction, whereby the planarity of the paper (i.e., a constant distance to the nozzle surface 40A) is ensured.

In other words, the provision of the star wheel 70 ensures the planarity of the paper (i.e., a constant distance to the nozzle surface 40A) even in the case where the maintenance device 81 including the cap member 80 and the like is disposed at the position opposite to the recording head unit 40.

Upon inputting a printing signal to the recording head units 40 of the recording head part 16 from a controlling part of the apparatus, a heating element of the nozzle corresponding to the printing signal generates heat, whereby an ink droplet is discharged to the paper conveyed with a constant distance to the nozzle surface 40A.

Accordingly, printing is carried out with the recording head array 42A, and subsequently, printing is carried out with the recording head array 42B, so as to complete printing in one color on the corresponding part of the paper. Upon conveying the paper in the recording part 20, printing is sequentially carried out with the recording heads 44Y, 44M, 44C and 44K to effect full color printing.

As described in the foregoing, the planarity of the paper (i.e., a constant distance to the nozzle surface 40A) is ensured, and printing is carried out on the paper conveyed at a constant velocity, whereby an image of high image quality can be formed. In particular, because the planarity is stably ensured with the star wheel 70 during conveying in the recording part 20, deformation caused during printing on various kinds of paper having variation in thickness can be favorably corrected, and thus the distance to the nozzle surface 40A can be maintained to a constant value to attain printing with high image quality.

In particular, in the recording part 20, the conveying rolls 100 are disposed between the recording head arrays 42 and also disposed on the upstream of the most upstream recording head array 42YA and on the downstream of the most downstream recording head array 42KB, and the plural conveying rolls 100 are driven with the single driving source. Consequently, the paper is certainly conveyed at a constant velocity to attain printing with high image quality.

The operation of dummy jet will be then described.

The dummy jet is carried out upon non-printing or after every times of completion of printing of a prescribed number of sheets during continuous printing of plural sheets of paper but before reaching an edge of subsequent paper. That is, ejection of an ink droplet is carried out from an arbitrary nozzle among all the recording head units 40 constituting the recording heads 44Y to 44K to the cap member 80 (i.e., so-called dummy jet). The dummy jet may be carried out for all the nozzles of all the recording head units 40, for all the nozzles 58 of the selected recording head unit 40 or the selected recording head array 42, or only for such a nozzle 58 that has not discharged an ink droplet for a prescribed period of time.

For example, the distance between the nozzle surface 40A and the upper surface of the cap member 80 upon carrying out the dummy jet during continuous printing of plural sheets of paper is set at 3 mm, and 500 droplets are discharged from all the nozzles, respectively, at the time between passage of preceding recording paper and arrival of subsequent recording paper by 30 sheets of A4 size paper.

At this time, the provision of the ink absorbent 86 at the bottom of the concave part 82A of the cap member 80 prevents the thus-discharged ink from suffering flood and splash from the concave part 82A.

For example, the change in ejection performance due to drying of an ink (particularly, an aqueous ink and a solvent ink) can be initialized by discharging ink droplets (dummy jet) from all the nozzles of the recording head unit 40. Even in the case of an oily ink and a solid ink, which are substantially not dried, the dummy jet can remove bubbles attached to the ink flow path inside the head and dusts attached on the nozzle surface upon printing, whereby the ejection performance of ink droplets of the nozzles can be initialized.

The printing speed (productivity) is improved in this example because the dummy jet can be carried out during continuous printing of plural sheets of paper thus conveyed without movement of the recording head 44 and the cap member 80. Furthermore, the printing performance of the recording head 44 can be constantly maintained by the dummy jet to enable printing with high image quality.

The wiping operation will be described.

The wiping operation is carried out before starting printing. The recording head 40 (nozzle surface 40A) is wiped with the wiping member 88 of the maintenance part 18. The specific operation will be described based on the schematic figures shown in FIGS. 25A to 25G.

The driving motor 304 of the elevating mechanism 302 shown in FIG. 24 is firstly driven to bring down the common substrate 300 by rotation of the eccentric cam 306. The driving motor 318 of the moving mechanism 312 is driven to raise the slider 314 and the common substrate 310 supported by the slider 314. Accordingly, the six cap members 80 attached to the common substrate 300 descend from the home position (i.e., moving in the direction of leaving from the recording head 40), and the six wiping member 88 attached to the common substrate 310 rise from the home position (i.e., moving in the direction of approaching the nozzle surface 40A of the recording head 40) as shown in FIGS. 25A and 25B.

In this example, the cap member 80 descends to the position at 6 mm from the nozzle surface 40A of the recording head unit 40 and the tip end (upper end) of the wiper 92 of the wiping member 88 rises to the position higher than the nozzle surface 40A by 1.5 mm (hereinafter, referred to as a contact amount of 1.5 mm).

As a result, the retaining member 90 of the wiping member 88 becomes movable by overstriding the cap member 80. The wiper 92 of the wiping member 88 is in such a state that it overlaps the nozzle surface 40A of the recording head 40 in the vertical direction (the direction shown by the arrow Z in FIGS. 25A to 25G) as shown in FIG. 25B.

In this state, the driving motor 316 of the moving mechanism 312 shown in FIG. 24 is driven to move the common substrate 310 in the width direction on the slider 314 through the rack 322 engaged with the driving gear 326. Accordingly, the wiping member 88 attached to the common substrate 310 is moved in the width direction, whereby the wiper 92 of the wiping member 88, the tip end of which is at a position higher than the nozzle surface 40A, is moved with slidingly contacting with the nozzle surface 40A of the recording head unit 40. As a result, dusts and a dried ink attached to the nozzle surface 40A are removed as shown in FIG. 25C. At this time, the wiping member 88 is moved by overstriding the cap member 80 thus having descended.

In this example, the wiper 92 is in slidingly contact with the nozzle surface 40A with maintaining the contact amount of 5 mm, whereby contamination attached to the nozzle surface 40A is certainly removed.

Figure 25D:
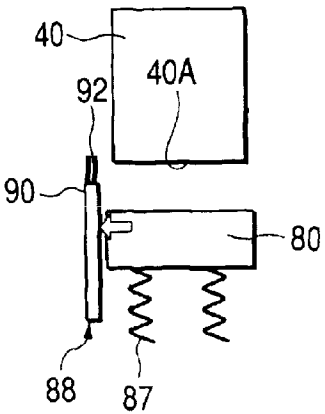
Figure 25E:
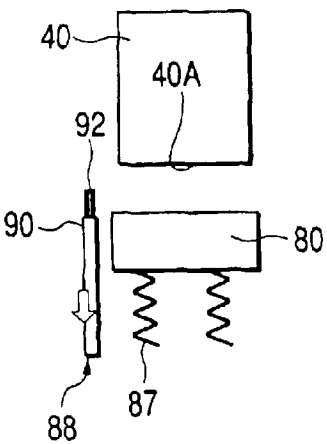

The wiping member 88 then escapes from the area under the nozzle surface 40A to complete the movement of the wiping member 88 and the guide member 94 in the width direction as shown in FIG. 25D. Subsequently, the common substrate 310, i.e., the wiping member 88, is brought down by driving the driving motor 318 of the moving mechanism 312 to move to the height of the home position as shown in FIG. 25E.

Figure 25F:
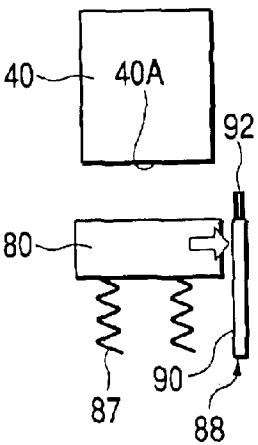
Figure 25G:
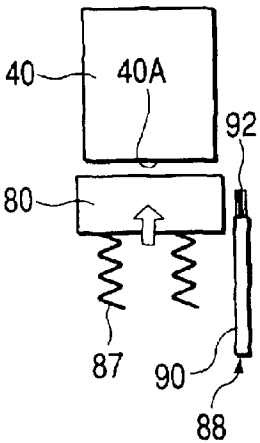
Figure 25G:
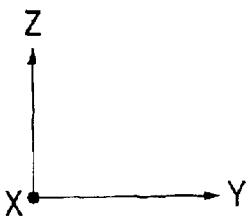

The common substrate 310, i.e., the wiping member 88, is then moved to the opposite side in the width direction by driving the driving motor 318 of the moving mechanism 312 shown in FIG. 22 to make it revert to the home position as shown in FIG. 25F. Furthermore, the cap member 80 is raised by driving the driving motor 304 of the elevating mechanism 302 to make it revert to the home position near the nozzle surface 40A of the recording head 40, whereby the wiping operation is completed as shown in FIG. 25G.

Subsequently, the capping operation will be described.

Figure 28A:
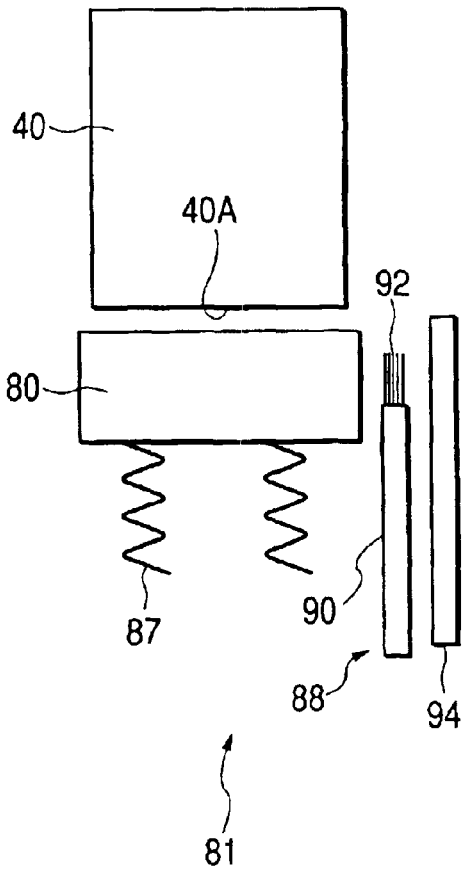
FIGS. 28A and 28B are operational explanatory views showing capping operation in a recording apparatus according to an embodiment of the invention.
Figure 28B:
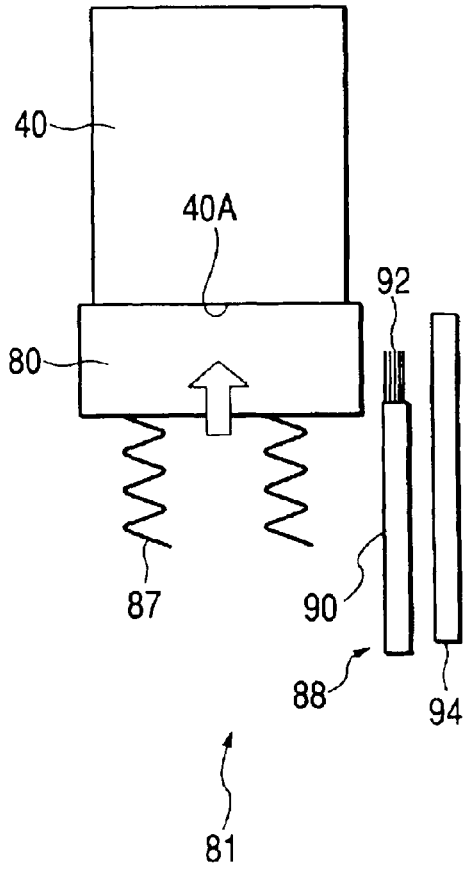
Figure 29:
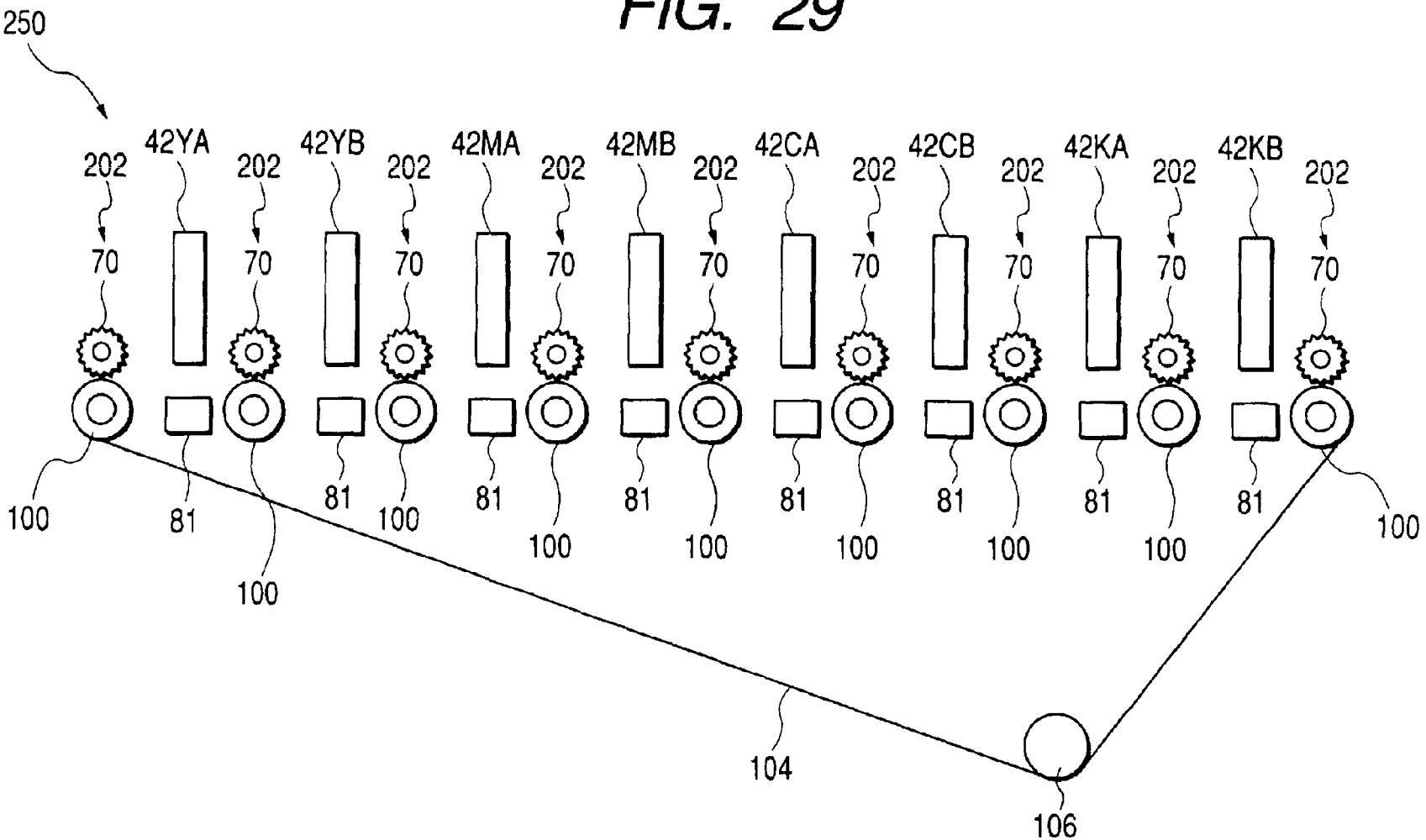
FIG. 29 is an explanatory view showing another example of the driving mechanism.

The capping operation is carried out in the case where the non-printing state continues for a long period of time, or in the case where the power of the apparatus is turned off. Specifically, the driving motor 304 of the elevating mechanism 302 shown in FIG. 24 is driven to raise the common substrate 300 to press the rubber member 84 of the cap member 80 attached to the common substrate 300 onto the nozzle surface 40A of the recording head 40 as shown in FIGS. 28A and 28B. As a result, the airtightness of the nozzle surface 40 (i.e., the nozzles 58) is ensured, whereby increased viscosity and drying of the ink are prevented, and attachment of dusts is also prevented.

As shown in FIG. 18, the recording head 44 in this example is constituted by attaching the recording head arrays 42A and 42B formed by arranging plural short recording head units 40 to the common substrates 46A and 46B, respectively, whereby the production thereof can be standardized as with inexpensive devices (recording heads), which are mass-produced, and the recording head 40 capable of printing on the entire width can be produced at low cost.

Furthermore, the recording head arrays 42A and 42B are attached to the common substrates 46A and 46B, respectively, whereby the constitutions of the recording head arrays 42A and 42B are simplified, and thus the production and the adjustment in high accuracy thereof can be conveniently carried out. Furthermore, there is such an advantage that the constitution of the maintenance part (including the cap member 80 and the wiping member 88) can be standardized as with those used in a recording head of a short length. Moreover, there is also such an advantage that a unit for making constant the distance between the nozzle surface 40A and the paper (e.g., the star wheel 70 in this example) can be disposed by utilizing the gap (space) among the recording head units in the width direction, or the degree of freedom in designing the arrangement of the cap member 80 can be increased by that gap (space).

While one cap member 80 is provided as corresponding to one recording head unit 40 in this example, only one cap member 80 may be provided as corresponding to plural recording head units 40.

In the recording apparatus according to the invention, the distance between the paper continuously conveyed and the nozzle surface of the recording head is uniformized, so as to realize printing with high image quality.

The entire disclosure of Japanese Patent Application No. 2003-069869 filed on Mar. 14, 2003 including specification, claims, drawings and abstract is incorporated herein by reference in its entirety.

What is claimed is:

1. A recording apparatus for recording images on a recording medium which is conveyed in a direction by discharging ink droplets from a recording head to the recording medium, the recording head having an ink discharging surface comprising:

a non-scanning recording head having a plurality of recording head units aligned in a width direction perpendicular to the conveying direction; and a uniformizing unit positioned between the recording head units for keeping a distance between the recording medium and the surface.

2. The recording apparatus according to claim 1, wherein the recording medium comprises a front surface for receiving the ink and a back surface, the uniformizing unit comprises a supporting member for supporting the back surface and a pressing member for pressing the recording medium on the supporting member, the supporting member and the pressing member define a paper path for transporting the recording medium.

3. The recording apparatus according to claim 2, further comprising a common substrate for holding the recording head units and the pressing members, the recording head units attached removably to the substrate.

4. The recording apparatus according to claim 2, wherein the pressing member comprises a contact member for contacting the recording medium and a pushing unit for pushing the contact member on the supporting member with a prescribed elastic force.

5. The recording apparatus according to claim 4, wherein the pushing unit is operable to adjust the force.

6. The recording apparatus according to claim 5, wherein the contact member is a spur.

7. The recording apparatus according to claim 6, wherein the spur is rotated following the conveyance of the recording medium.

8. The recording apparatus according to claim 1, further comprising a plurality of members for conveying the recording medium in the conveying direction.

9. The recording apparatus according to claim 8, wherein the member comprises a shaft and a plurality of spurs.

10. The recording apparatus according to claim 9, wherein the shaft is positioned along the direction perpendicular to the conveying direction.

11. The recording apparatus according to claim 10, wherein the spurs are held by the shaft at certain intervals.

12. The recording apparatus according to claim 11, wherein the recording head units are held by a recording head array and the member is provided between the recording head arrays.

13. The recording apparatus according to claim 12, wherein the member is arranged among the recording head arrays and on the upstream of the most upstream recording head array and on the downstream of the most downstream recording head array along the conveying direction.

14. A recording head array for discharging ink droplets to a recording medium, the recording head array comprising:

a plurality of recording head units, the recording head units having an ink discharging surface; and a uniformizing unit positioned between the recording head units for keeping a distance between the recording medium and the surface.

15. The recording head array according to claim 14, wherein the recording medium comprises a front surface for receiving the ink and a back surface, the member comprises a supporting member for supporting the back surface and a pressing member for pressing the recording medium on the supporting member.

16. The recording head array according to claim 15, further comprising a common substrate for holding the recording head units and the pressing member, the recording head units attached removably to the substrate.

17. The recording head array according to claim 16, wherein the pressing member comprises a contact member for contacting the recording medium and a pushing unit for pushing the contact member on the supporting member with a prescribed elastic force.

18. The recording head array according to claim 17, wherein the pushing unit is operable to adjust the force.

19. The recording head array according to claim 18, wherein the contact member is a spur.

20. The recording head array according to claim 19, wherein the spur is rotated following the conveyance of the recording medium.

* * * * *